US005934575A

United States Patent [19]

Ohnishi et al.

[11] Patent Number: 5,934,575

[45] Date of Patent: Aug. 10, 1999

[54] PNEUMATIC IMPACT PULVERIZER AND PROCESS FOR PRODUCING TONER

[75] Inventors: Toshinobu Ohnishi, Shizuoka-ken; Satoshi Mitsumura, Yokohama; Yoshinori Tsuji, Shizuoka-ken, all of Japan

[73] Assignee: Canon Kabushiki Kaisha, Tokyo, Japan

[21] Appl. No.: 08/995,901

[22] Filed: Dec. 22, 1997

[30] Foreign Application Priority Data

| | | | |
|---|---|---|---|
| Dec. 27, 1996 | [JP] | Japan | 8-356569 |
| Dec. 27, 1996 | [JP] | Japan | 8-356570 |
| Dec. 27, 1996 | [JP] | Japan | 8-356571 |
| Jun. 20, 1997 | [JP] | Japan | 9-163165 |

[51] Int. Cl.[6] ..... B02C 19/06

[52] U.S. Cl. ..... 241/5; 241/40

[58] Field of Search ..... 241/5, 39, 40

[56] References Cited

U.S. PATENT DOCUMENTS

| | | |
|---|---|---|
| 4,930,707 | 6/1990 | Oshiro et al. . |
| 5,165,549 | 11/1992 | Kanda et al. . |
| 5,316,222 | 5/1994 | Kanda et al. . |
| 5,358,183 | 10/1994 | Kanda et al. . |
| 5,435,496 | 7/1995 | Kanda et al. . |
| 5,577,670 | 11/1996 | Omata et al. . |

FOREIGN PATENT DOCUMENTS

| | | |
|---|---|---|
| 0 568 724 | 11/1993 | European Pat. Off. . |
| 57-50554 | 3/1982 | Japan . |
| 58-143853 | 8/1983 | Japan . |
| 1-148740 | 10/1989 | Japan . |
| 1-254266 | 10/1989 | Japan . |
| 5-309287 | 11/1993 | Japan . |
| 5-309288 | 11/1993 | Japan . |
| 8-182936 | 7/1996 | Japan . |
| 8-182937 | 7/1996 | Japan . |

*Primary Examiner*—Mark Rosenbaum

*Attorney, Agent, or Firm*—Fitzpatrick, Cella, Harper & Scinto

[57] ABSTRACT

A pneumatic impact pulverizer is disclosed which has a nozzle for feeding high-pressure gas, a tube for transporting and accelerating a pulverizing material, a pulverization chamber, and an impact member for pulverizing the material. The impact member is opposed to an outlet of the accelerating tube and has at least a first impact face projecting toward the accelerating tube side and a second impact face sloped toward the downstream side. The pulverization chamber has at least a first sidewall positioned on the side more upstream than the outermost edge of the second impact face and a second sidewall positioned on the downstream side of the first sidewall. The pulverization chamber is enlarged at its part on the side more upstream than the outermost edge of the second impact face so that the cross-sectional area of the inside of the chamber at that part is larger than that of the inside of the chamber corresponding to the outermost edge of the second impact face. The tip of the first impact face is positioned on the side more upstream than the downstream side edge of the first sidewall. The pulverization can be conducted in a very high efficiency with the pulverizer. Also, a process for producing a toner for developing electrostatic images using the pulverizer is disclosed.

52 Claims, 19 Drawing Sheets

PNEUMATIC IMPACT PULVERIZER AND PROCESS FOR PRODUCING TONER

BACKGROUND OF THE INVENTION

1. Field of the Invention

This invention relates to a pneumatic impact pulverizer for pulverizing powder materials by using air-jet streams (high-pressure gases), and a process for producing a toner which produces a toner for developing electrostatic images by means of the pulverizer.

2. Related Background Art

Toners or color resin powders for toners which are used in image forming methods carried out by electrophotography usually contain at least binder resins and colorants or magnetic powders. The toner develops an electrostatic image formed on a latent image bearing member, to form a toner image. The toner image thus formed is transferred to a recording medium such as plain paper or plastic film, and the toner image on the recording medium is fixed by a fixing means such as a heat fixing means, a pressure roller fixing means or a heat-pressure fixing means. Thus, the binder resins used in toners have the properties of undergoing plastic deformation upon application of heat or pressure.

At present, the toners or color resin powders for toners are prepared by melt-kneading a mixture containing a binder resin and a colorant or a magnetic powder (optionally further together with third components), cooling the resultant kneaded product, pulverizing the resultant cooled product and classifying the resultant pulverized product. The pulverization of the cooled product usually comprises crushing (or median pulverization) the cooled product by means of a mechanical impact pulverizer and subsequently finely pulverizing the crushed product by means of a pneumatic impact pulverizer making use of air-jet streams.

In the pneumatic impact pulverizer making use of air-jet streams, a powder material is carried on air-jet streams to form a particle-air mixture stream, which is then jetted out of an outlet of an accelerating tube, and this particle-air mixture stream is caused to collide against an impact member provided opposingly to the outlet of the accelerating tube so that the powder material is pulverized by the impact force.

As the above pneumatic impact pulverizer, machines as shown in FIGS. 16 and 17 have been used (Japanese Patent Application Laid-open No. 57-50554 and No. 58-143853).

In these pneumatic impact pulverizers, a powder material having a rough particle size is supplied from a hopper 22, and is sucked into an accelerating tube 1 through a powder material feed opening 24 communicating with the accelerating tube 1 at its middle portion, being sucked into the accelerating tube 1 by the action of a high-pressure gas fed through a high-pressure gas feed nozzle 25. The powder material thus sucked is jetted out of an outlet 10 of the accelerating tube 1 into a pulverization chamber 13 together with the high-pressure gas, is collided against an impact face 26 of an impact member 11 provided opposingly to the outlet 10, and is pulverized by the impact force. Then, the pulverized product is discharged out of the pulverization chamber 13 through a discharge outlet 14.

However, when the impact face 26 stands vertical to the axial direction of the accelerating tube 1 as shown in FIG. 16, the powder adjacent to the impact face 26 is in a high concentration and also the action of pulverization is chiefly the primary impact at the impact face 26, where the secondary impact against sidewalls 23 of the pulverization chamber is not effectively utilized, resulting in a low pulverization efficiency. In addition, when thermoplastic resin is pulverized, melt-deposits tend to occur on the impact face 26 because of local heat generation at the time of impact to cause a lowering of pulverization performance, making it difficult to achieve stable operation of the apparatus. Hence, it has been difficult to use the apparatus in the state of a high concentration for the powder to be fed into the accelerating tube.

In an instance where the impact face 26 is sloped by 45° with the axial direction of the accelerating tube as in the case of the pneumatic impact pulverizer shown in FIG. 17, the above problems may occur less even when the thermoplastic resin is pulverized, and the powder in the vicinity of the impact face 26 can be in a lower concentration than in the case of the pulverizer shown in FIG. 16. However, the impact force used in pulverization when the powder is collided is smaller and also the secondary impact against sidewalls 23 of the pulverization chamber can not be effectively utilized, resulting in a pulverization performance which is lower by ½ to 1/1.5 than the pulverizer shown in FIG. 16.

A pneumatic impact pulverizer having solved the above problems is proposed as disclosed in Japanese Patent Application Laid-open No. 1-254266 and Japanese Utility Model Application Laid-open No. 1-148740.

The former Japanese Patent Application Laid-open No. 1-254266 discloses a proposal of a pneumatic impact pulverizer in which, as shown in FIG. 18, the impact face 26 of the impact member 11 has a specific conical shape so that the powder in the vicinity of the impact face can be in a lower concentration and yet can be collided against the sidewalls 23 of the pulverization chamber with good efficiency.

The latter Japanese Utility Model Application Laid-open No. 1-148740 discloses a proposal that, as shown in FIG. 19, a peripheral impact face 18 of the impact member 11 is so disposed as to be at right angles with the axis of the accelerating tube and a conical projection 17 is provided at its center so that the flow of powder can be prevented from being reflected on the impact face.

The pneumatic impact pulverizers shown in FIGS. 18 and 19 can overcome the above problems, but not to an extent that can be well satisfactory.

As a pneumatic impact pulverizer having better overcome the above problems, Japanese Patent Application Laid-open No. 5-309288 and No. 5-309287 disclose some proposals.

In the former Japanese Patent Application Laid-open No. 5-309288, as shown in FIG. 20, a pulverizing material fed through a pulverizing material feed tube 6 reaches a pulverizing material feed opening 5 formed between the inner wall of an accelerating tube throat 2 of the accelerating tube 1 and the outer wall of a high-pressure gas feed nozzle 3. Meanwhile, the high-pressure gas is jetted out of the high-pressure gas feed nozzle 3 toward an accelerating tube outlet 10. Here, the pulverizing material is sucked from the pulverizing material feed opening 5 toward the accelerating tube outlet 10 while being accompanied with the gas present together with the material, and is uniformly mixed with the high-pressure gas at the accelerating tube throat 2. Then the pulverizing material is collided against the impact face 26 of an impact member 11 provided opposingly to the accelerating tube outlet 10, which is collided in a uniform state free of uneven powder concentration, and second-order collided against a pulverization chamber sidewall 23 with good efficiency. Thus, the yield of the pulverized product and the pulverization efficiency per unit weight can be improved.

The latter Japanese Patent Application Laid-open No. 5-309287 discloses a proposal of an impact member 11 constituted of, as shown in FIG. 21, two impact areas formed of a projected central area 17 and a peripheral impact face 18. The first-order pulverized product of the pulverizing material pulverized at the projected central area 17 is second-order pulverized at the peripheral impact face 18. The pulverization chamber 13 has a pulverization chamber sidewall 23 for third-order pulverizing the secondary pulverized product second-order pulverized at the peripheral impact face 18.

The pneumatic impact pulverizers shown in FIGS. 20 and 21 can reasonably overcome the above problems. However, as recent needs, there is a demand for a more finely pulverized product and it is long-awaited to provide a pulverizer having a much better pulverization efficiency. Specifically, in image forming methods carried out by electrophotography, it is desired to make toner particle diameter smaller in order to achieve a higher image quality and it is long-awaited to provide a process for producing toners with much better efficiency.

SUMMARY OF THE INVENTION

An object of the present invention is to solve the above problems the prior art has had, and to provide a novel pneumatic impact pulverizer that can pulverize a powder material with good efficiency, and a process for producing a toner by using such a pulverizer.

Another object of the present invention is to provide a pneumatic impact pulverizer that can pulverize a powder material with good efficiency by jetting a powder out of its accelerating tube outlet with well dispersed state to prevent the powder from agglomerating in the accelerating tube, and a process for producing a toner by using such a pulverizer.

Still another object of the present invention is to provide a pneumatic impact pulverizer that can pulverize a powder material in a good efficiency by causing a powder jetted out of an accelerating tube, to collide against an impact member at a great impact force, and a process for producing a toner by using such a pulverizer.

A further object of the present invention is to provide a pneumatic impact pulverizer that can perform multiple pulverization in which the powder material jetted out of an accelerating tube outlet and having collided against the impact face of an impact member further collides against the pulverization chamber inner walls, and a process for producing a toner by using such a pulverizer.

A still further object of the present invention is to solve the above problems the prior art has had, and to provide a toner production process by which toners for developing electrostatic images can be produced with good efficiency.

A still further object of the present invention is to provide a pneumatic impact pulverizer that can pulverize resin particles with an average particle diameter of from 200 to 2,000 $\mu$m into particles with an average particle diameter of from 3 to 15 $\mu$m with good efficiency, and a process for producing a toner by using such a pulverizer.

To achieve the above objects, the present invention provides a pneumatic impact pulverizer comprising;

a high-pressure gas feed nozzle for feeding a high-pressure gas;

an accelerating tube for transporting and accelerating a pulverizing material in the accelerating tube by the aid of the high-pressure gas fed through the high-pressure gas feed nozzle;

a pulverization chamber for pulverizing the pulverizing material ejected out of an accelerating tube outlet; and an impact member for pulverizing the pulverizing material ejected out of the accelerating tube outlet, provided at a position opposite to the accelerating tube outlet in the pulverization chamber;

wherein;

the impact member has at least a first impact face projecting toward the accelerating tube side at a vertical angle $\alpha$ around the axis of the accelerating tube and a second impact face sloped toward the downstream side at an angle $\beta$ with respect to a perpendicular line formed toward the axis of the accelerating tube;

the pulverization chamber has at least a first sidewall positioned on the side more upstream than the outermost edge of the second impact face and a second sidewall positioned on the downstream side of the first sidewall and extending toward the downstream side; and the pulverization chamber is enlarged at its part on the side more upstream than the outermost edge of the second impact face so as to have a zone where the cross-sectional area of the inside of the pulverization chamber is larger than the cross-sectional area of the inside of the pulverization chamber corresponding to the outermost edge of the second impact face, and the tip of the first impact face is positioned on the side more upstream than the downstream side edge of the first sidewall.

The present invention also provides a process for producing a toner, comprising the steps of;

melt-kneading a mixture containing at least a binder resin and a colorant, to obtain a kneaded product;

cooling the resultant kneaded product to solidify to obtain a solidified product;

crushing the resultant solidified product to obtain a crushed product; and pulverizing the resultant crushed product by means of a pneumatic impact pulverizer;

the pneumatic impact pulverizer comprising;

a high-pressure gas feed nozzle for feeding a high-pressure gas;

an accelerating tube for transporting and accelerating a pulverizing material in the accelerating tube by the aid of the high-pressure gas fed through the high-pressure gas feed nozzle;

a pulverization chamber for pulverizing the pulverizing material ejected out of an accelerating tube outlet; and an impact member for pulverizing the pulverizing material ejected out of the accelerating tube outlet, provided at a position opposite to the accelerating tube outlet in the pulverization chamber;

wherein;

the impact member has at least a first impact face projecting toward the accelerating tube side at a vertical angle $\alpha$ around the axis of the accelerating tube and a second impact face sloped toward the downstream side at an angle $\beta$ with respect to a perpendicular line formed toward the axis of the accelerating tube;

the pulverization chamber has at least a first sidewall positioned on the side more upstream than the outermost edge of the second impact face and a second sidewall positioned on the downstream side of the first sidewall and extending toward the downstream side; and the pulverization chamber is enlarged at its part on the side more upstream than the outermost edge of the second impact face so as to have a zone where the cross-sectional area of the inside of the pulverization chamber is larger than the cross-sectional area of the inside of the pulverization chamber corresponding to the outermost edge of the second impact face, and the tip of the first impact face is positioned on the side more upstream than the downstream side edge of the first sidewall.

DESCRIPTION OF THE PREFERRED EMBODIMENTS

As a result of extensive studies made on the pulverization efficiency of pneumatic impact pulverizers, the present inventors have discovered that the pulverization can be carried out in a very high efficiency, the pulverized product can be prevented from melt-adhering, agglomerating and being formed in coarse particles and the inner walls of the accelerating tube and the impact faces of the impact member can be prevented from being locally worn to enable stable operation when an impact member having a specific shape is used, the positional relationship between the accelerating tube outlet and the impact member is specified and the shapes of the pulverization chamber inner walls are specified. Thus, they have accomplished the present invention.

Embodiments of the present invention will be described below with reference to the accompanying drawings.

Figure 1:
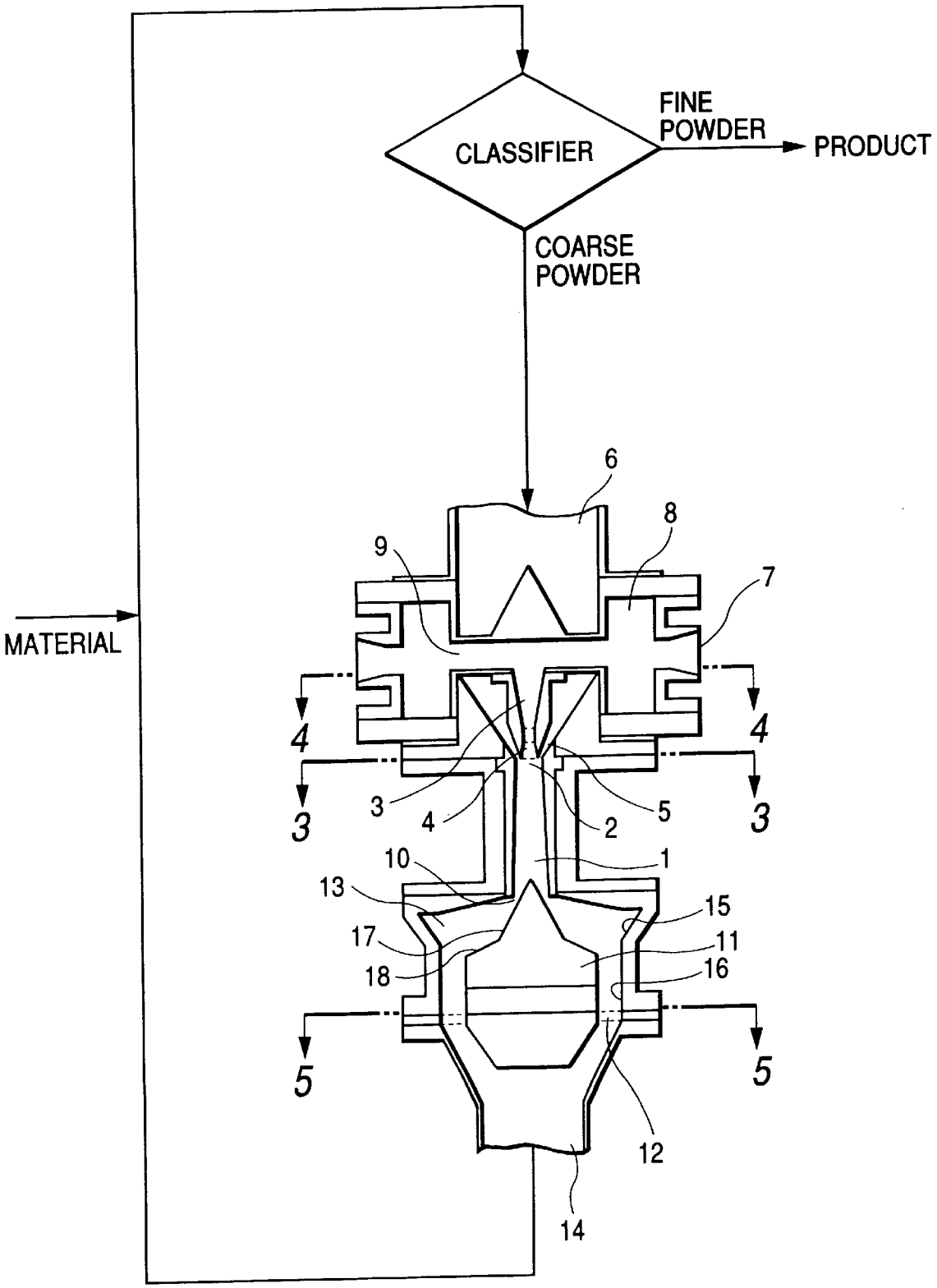
FIG. 1 is a schematic cross section illustrating an example of the pneumatic impact pulverizer according to the present invention.
Figure 2:
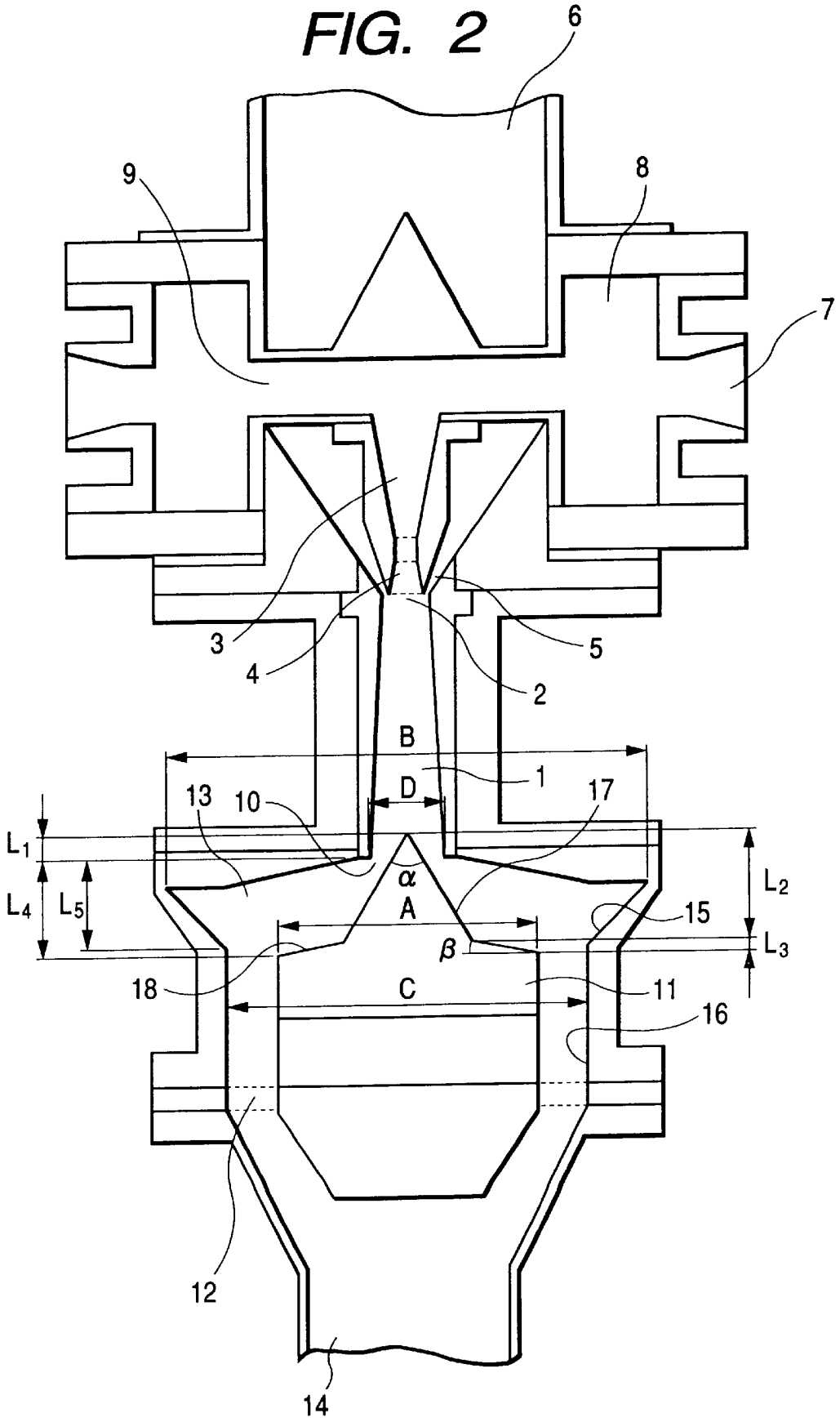
FIG. 2 is an enlarged view of the pulverizer shown in FIG. 1.
Figure 3:
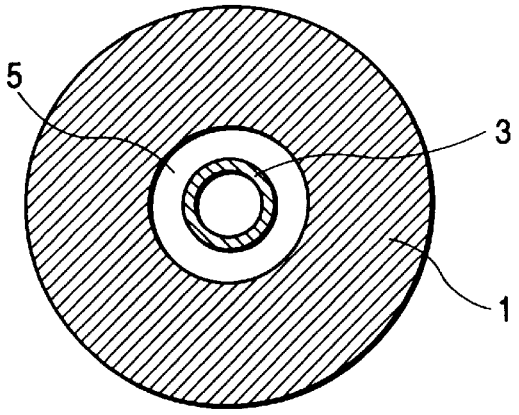
FIG. 3 is a cross section along the line 3—3 in FIG. 1.
Figure 4:
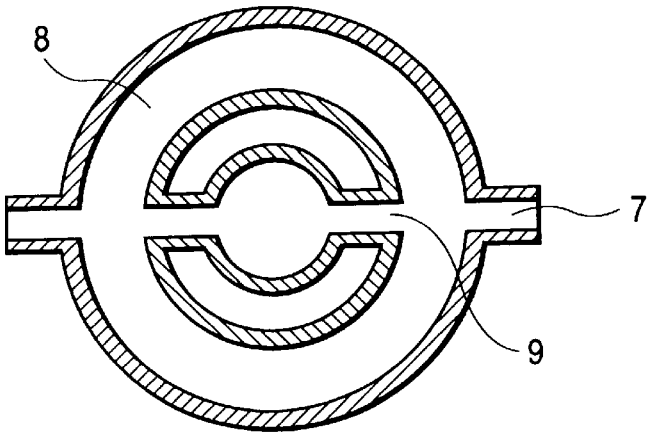
FIG. 4 is a cross section along the line 4—4 in FIG. 1.
Figure 5:
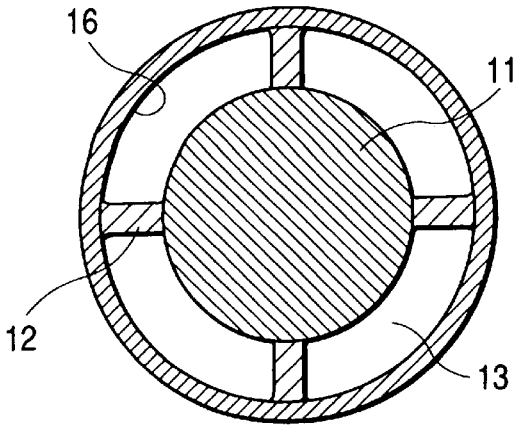
FIG. 5 is a cross section along the line 5—5 in FIG. 1.

FIG. 1 is a schematic cross section illustrating a first embodiment of the pneumatic impact pulverizer according to the present invention, and also shows a flow chart of a pulverization system in which the step of pulverization employing this pulverizer and the step of classification by means of a classifier are set up in combination. FIG. 2 is an enlarged view of the pneumatic impact pulverizer shown in FIG. 1. FIG. 3 is a cross section illustrating an accelerating tube throat 2 and a high-pressure gas feed nozzle 3 along the line 3—3 in FIG. 1. FIG. 4 is a cross section illustrating a high-pressure gas feed opening 7 and a high-pressure gas chamber 8 along the line 4—4 in FIG. 1. FIG. 5 is a cross section illustrating a pulverization chamber 13 and an impact member 11 along the line 5—5 in FIG. 1.

A process of pulverization of a powder material (pulverizing material) by means of the pneumatic impact pulverizer according to the present invention will be described below with reference to FIG. 1. The pulverizing material fed through a pulverizing material feed tube 6 reaches a pulverizing material feed opening 5 formed between the inner wall of an accelerating tube throat 2 of an accelerating tube 1 provided in the vertical direction along its central axis and the outer wall of a high-pressure gas feed nozzle 3 whose center is on the axis of the accelerating tube 1. Meanwhile, the high-pressure gas is introduced inside through the high-pressure gas feed opening 7, passed through a high-pressure gas chamber 8, passed through one high-pressure gas feed tube 9 which is preferably provided in plurality, and jetted out of the high-pressure gas feed nozzle 3 toward an accelerating tube outlet 10 while being expanded. Here, by the aid of the ejector effect produced in the vicinity of the accelerating tube throat 2, the pulverizing material is sucked from the pulverizing material feed opening 5 toward the accelerating tube outlet 10 while being accompanied with the gas present together with the material, is fed into the accelerating tube 1 through the circumference of the accelerating tube 1, and is rapidly accelerated while being uniformly mixed with the high-pressure gas at the accelerating tube throat 2, where the pulverizing material is collided against the impact face of an impact member 11 provided opposingly to the accelerating tube outlet 10, which is collided in a uniform solid-gas mixed stream state free of uneven powder concentration, and thus pulverized.

In the pulverizer shown in FIG. 1, the impact face of the impact member 11 has a projected central area 17 (first impact face) projecting in a conical shape and a peripheral impact face 18 (second impact face) formed around the projected central area 17, for further impact-pulverizing the first-order pulverized product of the pulverizing material pulverized at the projected central area 17. The pulverization chamber 13 has a pulverization chamber downstream sidewall 16 (second sidewall) for third-order impact-pulverizing the secondary pulverized product second-order pulverized at the peripheral impact face 18 and a pulverization chamber upstream sidewall 15 (first sidewall) forming a space wider than the pulverization chamber downstream sidewall 16. That is, the cross-sectional area of the inside of the pulverization chamber at its pulverization chamber upstream sidewall 15 is larger than the cross-sectional area of the inside of the pulverization chamber at its pulverization chamber downstream sidewall 16.

The impact force produced at the time of impact is imparted to individual particles (the pulverizing material) well dispersed, and the pulverizing material pulverized at the impact face of the impact member 11 further repeatedly undergoes third-order impact between the pulverization chamber downstream sidewall 16 and the impact member 11, and, with an improved pulverization efficiency, is discharged out of a pulverized product discharge outlet 14 provided at the rear of the impact member 11.

Figure 6:
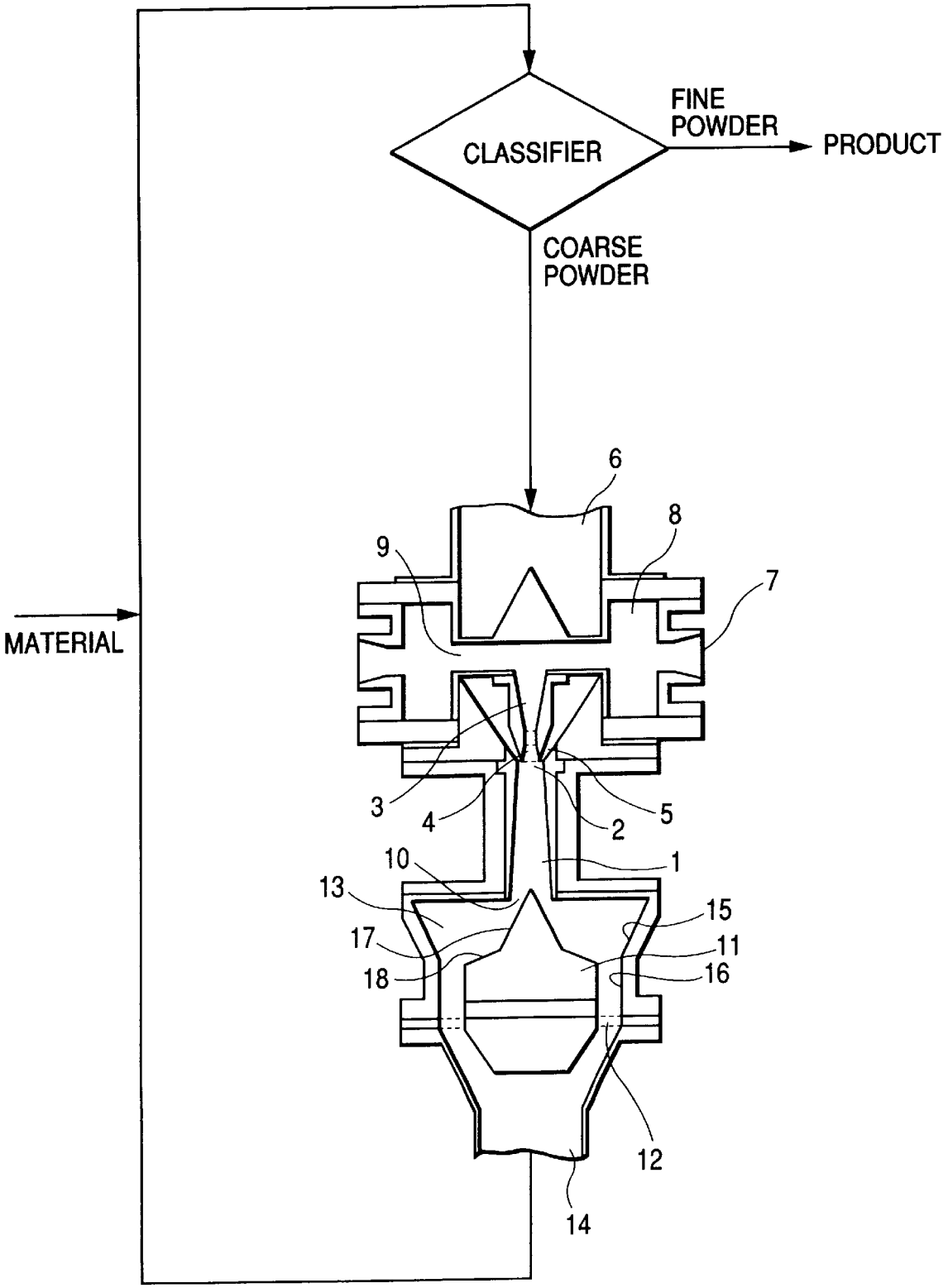
FIG. 6 is a schematic cross section illustrating another example of the pneumatic impact pulverizer according to the present invention.
Figure 7:
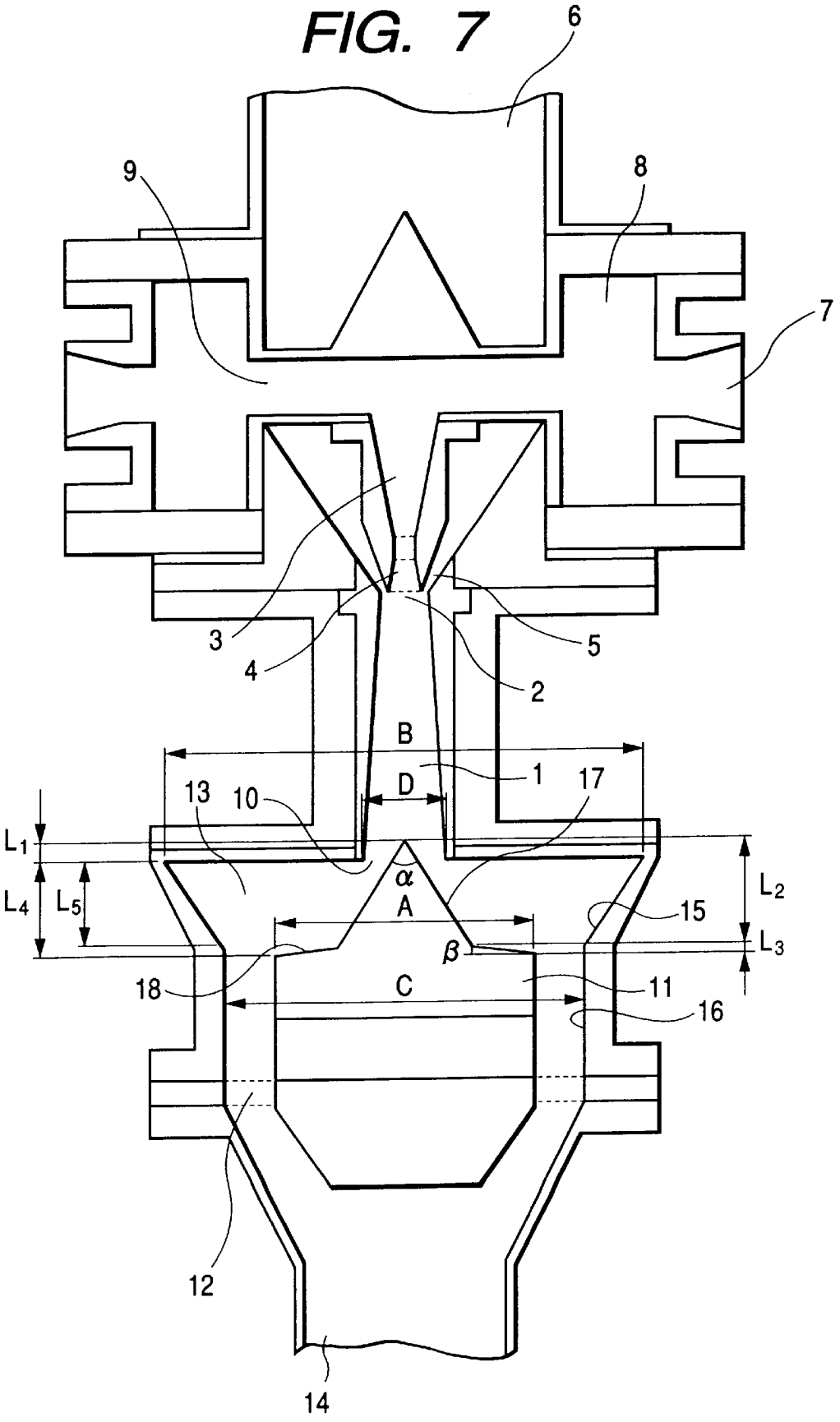
FIG. 7 is an enlarged view of the pulverizer shown in FIG. 6.

The diameter (width B) of the space formed by the pulverization chamber upstream sidewall 15 is larger than the diameter (width C) of the space formed by the pulverization chamber downstream sidewall 16, and a pulverization chamber 13 gradually widened from the accelerating tube outlet 10 to the pulverization chamber upstream sidewall 15 is formed. Thus, the back pressure in the vicinity of the accelerating tube outlet 10 can be made lower, thereby making it possible to set the impact member 11 near to the accelerating tube outlet 10. Because of this effect, the uniform solid-gas mixed stream free of uneven powder concentration can be well accelerated by the accelerating tube 1, and hence the pulverizing material is collided at a great impact force against the impact member 11 provided opposingly to the accelerating tube outlet 10 and is pulverized in a very high efficiency. Moreover, to the pulverizing material jetted out of the accelerating tube outlet 10, a speed produced in the direction of the pulverization chamber upstream sidewall 15 is appropriately added in addition to a speed produced in the axial direction of the accelerating tube 1, and hence the pulverizing material is effectively second-order pulverized at the peripheral impact face 18 and third-order pulverized at the pulverization chamber downstream sidewall 16. Such an operational effect can be obtained also when, as shown in FIGS. 6 and 7, the diameter (width) of the pulverization chamber 13 is made larger in the direction perpendicular to the axial direction of the accelerating tube 1 from the accelerating tube outlet 10. FIG. 6 is a schematic cross section illustrating such a pneumatic impact pulverizer, and also shows a flow chart of a pulverization system in which the step of pulverization employing this pulverizer and the step of classification by means of a classifier are set up in combination. FIG. 7 is an enlarged view of the pneumatic impact pulverizer shown in FIG. 6.

Since the impact face of the impact member 11 has the projected central area 17 projecting in a conical shape and the peripheral impact face 18 formed around the projected central area 17, none of melt-adhesion, agglomeration and formation of coarse particles may occur when resins or pulverizing materials with a stickiness are pulverized, and they can be pulverized in the state of a high powder concentration. In addition, in the case of pulverizing materials with wearability, the wear that may occur on the inner walls of the accelerating tube and on the impact face of the impact member 11 does not localize and the pulverizer can enjoy a long lifetime and can be stably operated.

The pulverizing material can be third-order pulverized in a better efficiency at a pulverization chamber impact wall 19 (FIGS. 8 and 9) which may be provided in the pulverization chamber 13, and at the pulverization chamber downstream sidewall 16.

The present pulverizer will be described below in greater detail with reference to FIG. 2, which is an enlarged view of the pneumatic impact pulverizer shown in FIG. 1.

The pneumatic impact pulverizer of the present invention has at least the high-pressure gas feed nozzle for feeding a high-pressure gas, the accelerating tube for transporting and accelerating a pulverizing material by the aid of the high-pressure gas fed through the high-pressure gas feed nozzle, the pulverization chamber for finely grinding the pulverizing material ejected out of the accelerating tube outlet, and the impact member against which the pulverizing material ejected out of the accelerating tube outlet collides, provided at a position opposite to the accelerating tube outlet in the pulverization chamber.

In the above pulverizer, the impact member has at least a first impact face projecting toward the accelerating tube side at a vertical angle $\alpha$ around the axis (imaginary axis) of the accelerating tube and a second impact face sloped toward the downstream side at an angle $\beta$ with respect to a perpendicular line formed toward the axis of the accelerating tube;

the pulverization chamber has at least a first sidewall positioned on the side more upstream than the outermost edge of the second impact face and a second sidewall positioned on the downstream side of the first sidewall and extending toward the downstream side; and on the downstream side of the accelerating tube, the pulverization chamber is enlarged at its part on the side more upstream than the outermost edge of the second impact face, and the tip of the first impact face is positioned on the side more upstream than the downstream side edge of the first sidewall. Thus, the second sidewall is positioned opposingly to the outermost edge of the second impact face of the impact member.

In the first embodiment of the pneumatic impact pulverizer according to the present invention, when the diameter across the outermost edge of the peripheral impact face 18 is represented by width A, the maximum diameter of the space formed by the upstream sidewall 15 of the pulverization chamber standing opposite to the impact member 11 by width B, and the minimum diameter of the space formed by the pulverization chamber downstream sidewall 16 by width C, the A, B and C may preferably satisfy the following relationship:

$$C<B\leqq 1.6\times C$$

$$A<C<1.6\times A$$

and may more preferably satisfy the following relationship:

$$C<B\leqq 1.2\times C$$

$$A<C<1.5\times A.$$

In the first embodiment of the pneumatic impact pulverizer according to the present invention, when the diameter of the accelerating tube outlet 10 is represented by D, the distance between the accelerating tube outlet 10 and the top of the projected central area 17, which is the first impact face of the impact member 11, by L1, the height of the projected central area 17 serving as the first impact face by L2, the height of the peripheral impact face 18 serving as the second impact face by L3, the distance between the outermost edge of the peripheral impact face 18 and the accelerating tube outlet 10 by L4, and the distance between the accelerating tube outlet 10 and the second-sidewall pulverization chamber downstream sidewall 16 by L5, the L1 to L5 may preferably satisfy the following relationship:

$$|L1|\leqq D/\{2\times\tan(\alpha/2)\}$$

$$L5\leqq L4\leqq L2+L3$$

and may more preferably satisfy the following relationship:

$0<L1 \leqq D/\{2\times\tan(\alpha/2)\}$ $L5 \leqq L4 \leqq L2+L3$.

(These height and distance are height and distance along the axial direction of the accelerating tube. When the tip of the projected central area 17 of the impact member 11 is positioned on the side more upstream than the accelerating tube outlet 10, L1 becomes plus. When on the other hand the tip of the projected central area 17 of the impact member 11 is positioned on the side more downstream than the accelerating tube outlet 10, L1 becomes minus.)

If $C \geqq B$, the pressure loss in the vicinity of the accelerating tube outlet 10 increases to cause a decrease in the velocity of the high-pressure gas (solid-gas mixed stream) in the accelerating tube 1, so that the ejector effect at the accelerating tube throat 2 may lower to cause a decrease in suction quantity of the powder material and also the powder material may be insufficiently accelerated to bring about a weak impact force at the impact face of the impact member 11, resulting in a decrease in pulverization efficiency.

If $B>1.6\times C$, the powder material jetted out of the accelerating tube outlet 10 may become excessively expanded before it collides against the impact member 11, to cause a decrease in the flying velocity of the powder material in the vicinity of the impact face of the impact member 11 and bring about a weak impact force, resulting in a decrease in pulverization efficiency.

If $A \geqq C$, the flow path between the impact member 11 and the pulverization chamber downstream sidewall 16 is blocked at the outermost edge of the peripheral impact face 18.

If $1.6\times A \leqq C$, the distance between the peripheral impact face 18 and the pulverization chamber downstream sidewall 16 is too large to attain effective third-order impact at the pulverization chamber downstream sidewall 16, resulting in a decrease in pulverization efficiency.

If $L1<-D/\{2\times\tan(\alpha/2)\}$, the impact member 11 is excessively distant from the accelerating tube outlet 10 to bring about a weak impact force, resulting in a decrease in pulverization efficiency.

If $L1>D/\{2\times\tan(\alpha/2)\}$, the accelerating tube outlet 10 is blocked with the projected central area 17 of the impact member 11.

What is meant by $0<L1$ is that the tip of the first impact face projects into the accelerating tube 1. In this instance, the pulverization efficiency is more improved.

If $L5>L4$, the second-order pulverized product second-order pulverized at the peripheral impact face 18 does not effectively third-order collide against the pulverization chamber downstream sidewall 16, resulting in a decrease in pulverization efficiency.

If $L4>L2+L3$, the peripheral impact face 18 is excessively distant from the accelerating tube outlet 10 to bring about a weak impact force, resulting in a decrease in pulverization efficiency.

In the pneumatic impact pulverizer of the present invention, the vertical angle $\alpha$ (degree) of the first impact face projected central area 17, projecting in a conical shape, and the angle $\beta$ (degree) of slope of the second impact face peripheral impact face 18 sloped toward the downstream side with respect to a perpendicular line formed toward the axis of the accelerating tube 1 may preferably satisfy the following relationship:

$0<\alpha<90,\ \beta>0$ $30 \leqq (\alpha+2\beta) \leqq 90$ and may more preferably satisfy the following relationship:

$0<\alpha<90,\ \beta>0$ $50 \leqq (\alpha+2\beta) \leqq 90$.

If the peripheral impact face 18 is not sloped toward the downstream side with respect to a perpendicular line formed toward the axis of the accelerating tube 1 and is vertical with respect to the axis of the accelerating tube 1 (i.e., an instance of $\beta=0$), the flow reflected on the peripheral impact face 18 is directed to the solid-gas mixed stream jetted out of the accelerating tube outlet 10 to tend to cause a disturbance in the solid-gas mixed stream, and also the powder concentration becomes higher at the peripheral impact face 18 to tend to cause melt-deposits and agglomerates on the peripheral impact face 18 when a powder of thermoplastic resin or a powder chiefly composed of thermoplastic resin is used as the pulverizing material. Occurrence of such melt-deposits makes it difficult for the apparatus to be stably operated.

If $(\alpha+2\beta)<30$, the impact force of first-order pulverization at the projected central area 17 may be so weak as to tend to cause a decrease in pulverization efficiency.

If $(\alpha+2\beta)>90$, the first-order pulverized product first-order pulverized at the projected central area 17 does not effectively second-order collide against the peripheral impact face 18, and also the flow reflected on the peripheral impact face 18 strongly tends to be directed to the downstream side to bring about a weak impact force of the third-order pulverization at the pulverization chamber downstream sidewall 16, tending to cause a decrease in pulverization efficiency.

As described above, according to the pneumatic impact pulverizer of the present invention, in which the impact member having a specific shape is used, the positional relationship between the accelerating tube outlet and the impact member is specified and the shapes of the pulverization chamber inner walls are specified, the powder material can be pulverized in a very high efficiency manner. More specifically, the pulverizing material jetted out of the accelerating tube outlet 10 under a low back pressure of the pulverization chamber 13 in the vicinity of the accelerating tube outlet 10 and in a rapidly accelerated state is first-order, second-order and third-order pulverized at a great impact force attributable to the impact member 11, thus the pulverization efficiency can be improved.

In the pneumatic impact pulverizer of the present invention, the pulverization chamber 13 is made larger at the pulverization chamber upstream sidewall 15 than at the pulverization chamber downstream sidewall 16. Also, in order to more effectively carry out third-order pulverization when the second-order pulverized product second-order pulverized at the second impact face peripheral impact face 18 is third-order impact-pulverized, a pneumatic impact pulverizer according to a second embodiment as shown in FIGS. 8 and 9 is preferred, in which the pulverization chamber downstream sidewall 16 is provided with a pulverization chamber impact wall 19 as a third sidewall sloped at an angle $\theta$ (degree) toward the outer side with respect to the axis of the accelerating tube 1 and toward the downstream side; the wall 19 being so formed as to connect the first sidewall with the second sidewall.

Figure 8:
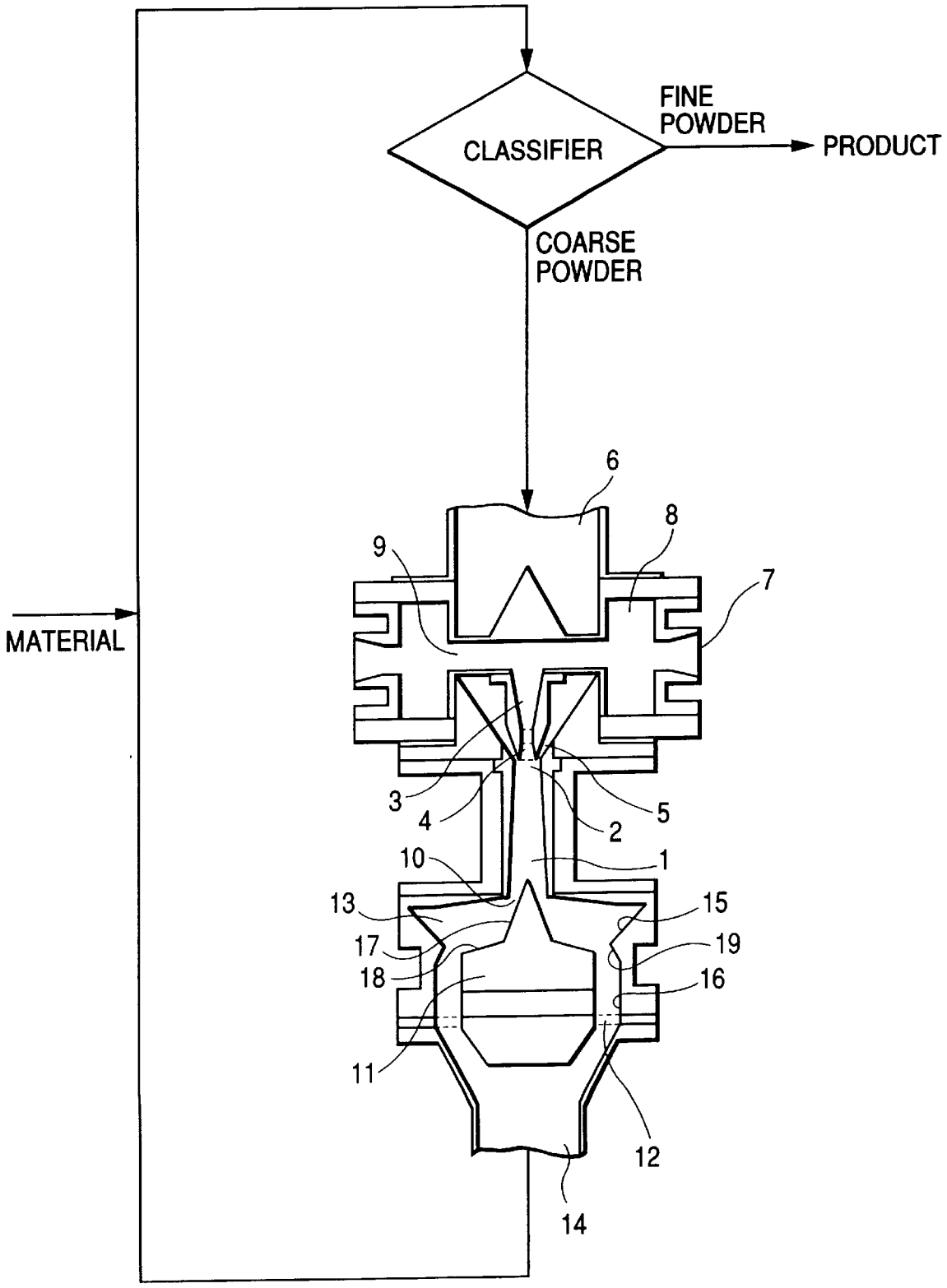
FIG. 8 is a schematic cross section illustrating still another example of the pneumatic impact pulverizer according to the present invention.
Figure 9:
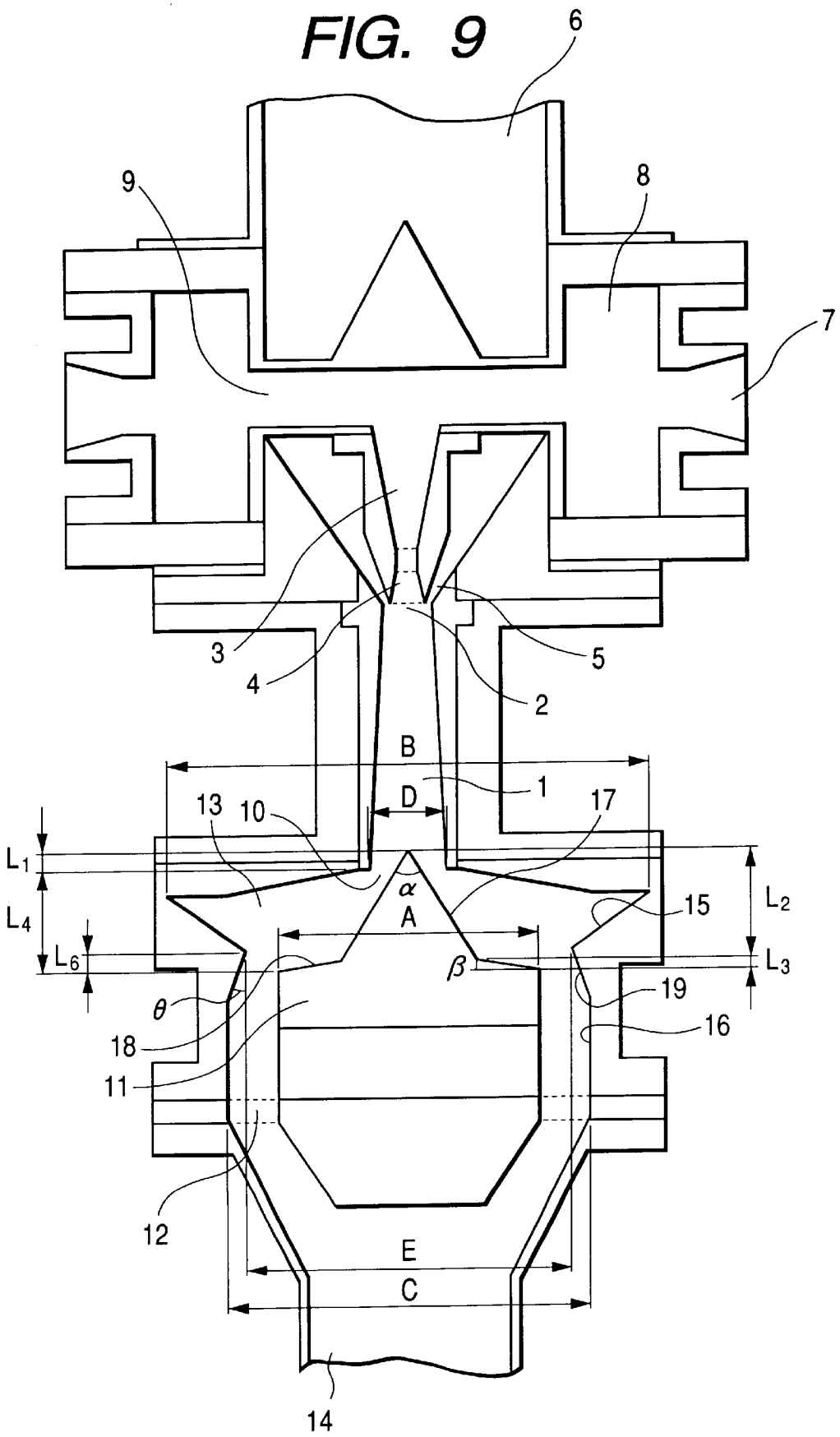
FIG. 9 is an enlarged view of the pulverizer shown in FIG. 8.

FIG. 8 is a schematic cross section illustrating the second embodiment of the pneumatic impact pulverizer according to the present invention, and also shows a flow chart of a pulverization system in which the step of pulverization employing this pulverizer and the step of classification by means of a classifier are set up in combination. FIG. 9 is an enlarged view of the pneumatic impact pulverizer shown in FIG. 8.

In the second embodiment of the pneumatic impact pulverizer according to the present invention, when the diameter across the outermost edge of the peripheral impact face 18 as the second impact face is represented by width A, the maximum diameter of the space formed by the upstream sidewall 15 of the pulverization chamber standing opposite to the impact member 11 by width B, the diameter of the space formed by the pulverization chamber impact wall 19 at its innermost edge (i.e., at the narrowest portion) by width E, and the minimum diameter of the space formed by the second sidewall 16 by width C, the A, B, C and E may preferably satisfy the following relationship:

$$C < B \leq 2 \times C$$

$$A < C < 1.6 \times A$$

$$C > E$$

and may more preferably satisfy the following relationship:

$$C < B \leq 1.3 \times C$$

$$A < C < 1.5 \times A$$

$$C > E.$$

In the second embodiment of the pneumatic impact pulverizer according to the present invention, when the diameter of the accelerating tube outlet 10 is represented by D, the distance between the accelerating tube outlet 10 and the top of the projected central area 17, which is the first impact face of the impact member 11, by L1, the height of the projected central area 17 serving as the first impact face by L2, the height of the peripheral impact face 18 serving as the second impact face by L3, the distance between the outermost edge of the peripheral impact face 18 serving as the second impact face and the accelerating tube outlet 10 by L4, and the distance between the outermost edge of the peripheral impact face 18 serving as the second impact face and the innermost edge of the pulverization chamber impact wall 19 serving as a third sidewall by L6, the L1, L2, L3, L4 and L6 may preferably satisfy the following relationship:

$$|L1| \leq D/\{2 \times \tan(\alpha/2)\}$$

$$L6 \leq L4 \leq L2 + L3$$

$$0 < L6 < 2 \times L3$$

and may more preferably satisfy the following relationship:

$$0 < L1 \leq D/\{2 \times \tan(\alpha/2)\}$$

$$L6 \leq L4 \leq L2 + L3$$

$$0 < L6 < 2 \times L3.$$

(These height and distance are height and distance along the axial direction of the accelerating tube. When the tip of the projected central area 17 of the impact member 11 is positioned on the side more upstream than the accelerating tube outlet 10, L1 becomes plus. When on the other hand the tip of the projected central area 17 of the impact member 11 is positioned on the side more downstream than the accelerating tube outlet 10, L1 becomes minus.)

The angle (θ) of slope of the third sidewall (the pulverization chamber impact wall 19) may also preferably satisfy the following relationship:

$0<\theta<40$ and may more preferably satisfy the following relationship:

$0<\theta<10$.

If $C \geqq B$, the pressure loss in the vicinity of the accelerating tube outlet 10 increases to cause a decrease in the velocity of the high-pressure gas (solid-gas mixed stream) in the accelerating tube 1, so that the ejector effect at the accelerating tube throat 2 may lower to cause a decrease in suction quantity of the powder material and also the powder material may be insufficiently accelerated to bring about a weak impact force at the impact face of the impact member 11, resulting in a decrease in pulverization efficiency.

If $B>2\times C$, the powder material jetted out of the accelerating tube outlet 10 may become excessively expanded before it collides against the impact member 11, to cause a decrease in the flying velocity of the powder material in the vicinity of the impact face of the impact member 11 and bring about a weak impact force, resulting in a decrease in pulverization efficiency.

If $A \geqq C$, the flow path between the impact member 11 and the pulverization chamber downstream sidewall 16 is blocked at the outermost edge of the peripheral impact face 18.

If $1.6\times A \leqq C$, the distance between the peripheral impact face 18 and the pulverization chamber downstream sidewall 16 is too large to attain effective third-order impact at the pulverization chamber downstream sidewall 16, resulting in a decrease in pulverization efficiency.

If $C \leqq E$, the distance between the pulverization chamber impact wall 19 and the impact member 11 is so small that as stated above the pressure loss at this portion increases to cause a decrease in suction quantity of the powder material and also the powder material may be insufficiently accelerated to bring about a weak impact force at the impact face of the impact member 11, resulting in a decrease in pulverization efficiency.

If $L1<-D/\{2\times\tan(\alpha/2)\}$, the impact member 11 is excessively distant from the accelerating tube outlet 10 to bring about a weak impact force, resulting in a decrease in pulverization efficiency.

If $L1>D/\{2\times\tan(\alpha/2)\}$, the accelerating tube outlet 10 is blocked with the projected central area 17 of the impact member 11.

What is meant by $0<L1$ is that the tip of the first impact face projects into the accelerating tube 1. In this instance, the pulverization efficiency is more improved.

If $L6>L4$, the second-order pulverized product second-order pulverized at the peripheral impact face 18 does not effectively third-order collide against the pulverization chamber downstream sidewall 16, resulting in a decrease in pulverization efficiency.

If $L4>L2+L3$, the peripheral impact face 18 is excessively distant from the accelerating tube outlet 10 to bring about a weak impact force, resulting in a decrease in pulverization efficiency.

If $L6 \geqq 2\times L3$, the second-order pulverized product second-order pulverized at the peripheral impact face 18 does not effectively third-order collide against the pulverization chamber impact wall 19, resulting in a decrease in pulverization efficiency.

If $\theta=0$, the distance between the pulverization chamber impact wall 19 and the peripheral edge (in particular, the peripheral impact face 18) of the impact member 11 is too large to attain effective third-order impact, resulting in a decrease in pulverization efficiency.

If $\theta \geqq 40$, the distance between the pulverization chamber impact wall 19 and the peripheral edge of the impact member 11 is so small that as stated above the pressure loss at this portion increases to cause a decrease in suction quantity of the powder material and also the powder material may be insufficiently accelerated to bring about a weak impact force at the impact face of the impact member 11, resulting in a decrease in pulverization efficiency.

In the pneumatic impact pulverizer of the present invention, the vertical angle $\alpha$ (degree) of the first impact face projected central area 17, projecting in a conical shape, and the angle $\beta$ (degree) of slope of the second impact face peripheral impact face 18 sloped toward the downstream side with respect to a perpendicular line formed toward the axis of the accelerating tube 1 may preferably satisfy the following relationship:

$0<\alpha<90,\ \beta>0$ $30\leqq(\alpha+2\beta)\leqq 90$ and may more preferably satisfy the following relationship:

$0<\alpha<90,\ \beta>0$ $50\leqq(\alpha+2\beta)\leqq 90.$

If the peripheral impact face 18 is not sloped toward the downstream side with respect to a perpendicular line formed toward the axis of the accelerating tube 1 and is vertical with respect to the axis of the accelerating tube 1 (i.e., an instance of $\beta=0$), the flow reflected on the peripheral impact face 18 is directed to the solid-gas mixed stream jetted out of the accelerating tube outlet 10 to tend to cause a disturbance in the solid-gas mixed stream, and also the powder concentration becomes higher at the peripheral impact face 18 to tend to cause melt-deposits and agglomerates on the peripheral impact face 18 when a powder of thermoplastic resin or a powder chiefly composed of thermoplastic resin is used as the pulverizing material. Occurrence of such melt-deposits makes it difficult for the apparatus to be stably operated.

If $(\alpha+2\beta)<30$, the impact force of first-order pulverization at the projected central area 17 may be so weak as to tend to cause a decrease in pulverization efficiency.

If $(\alpha+2\beta)>90$, the first-order pulverized product first-order pulverized at the projected central area 17 does not effectively second-order collide against the peripheral impact face 18, and also the flow reflected on the peripheral impact face 18 strongly tends to be directed to the downstream side to bring about a weak impact force of the third-order pulverization at the pulverization chamber downstream sidewall 16, tending to cause a decrease in pulverization efficiency.

As described above, according to the pneumatic impact pulverizer of the present invention, in which the impact member having a specific shape is used, the positional relationship between the accelerating tube outlet and the impact member is specified and the shapes of the pulverization chamber inner walls are specified, the powder material can be pulverized in a very high efficiency. More specifically, the pulverizing material jetted out of the accelerating tube outlet 10 under a low back pressure of the pulverization chamber 13 in the vicinity of the accelerating tube outlet 10 and in a rapidly accelerated state is first-order, second-order and third-order pulverized at a great impact force attributable to the impact member 11, thus the pulverization efficiency can be improved.

Figure 10:
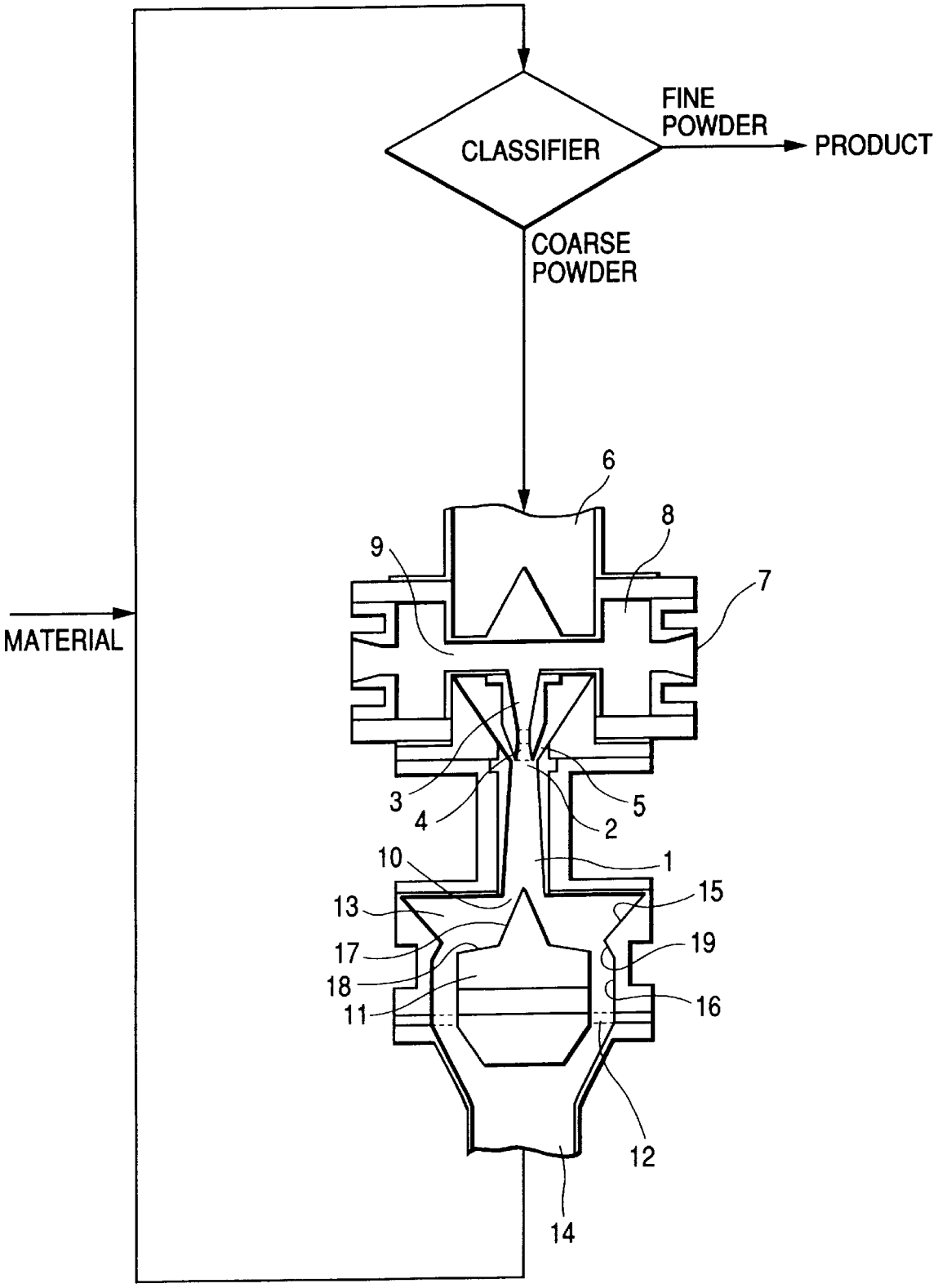
FIG. 10 is a schematic cross section illustrating a further example of the pneumatic impact pulverizer according to the present invention.
Figure 11:
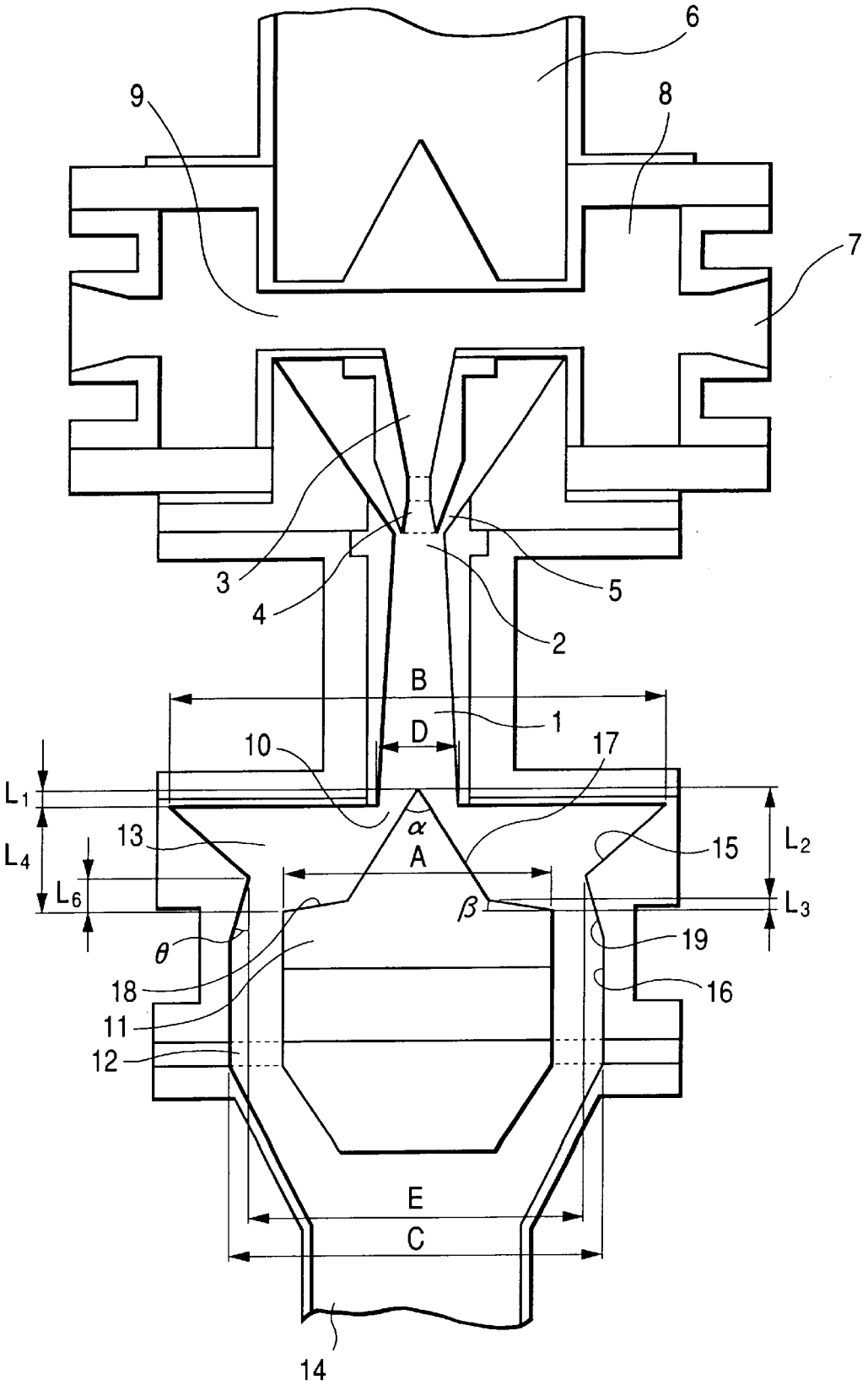
FIG. 11 is an enlarged view of the pulverizer shown in FIG. 10.

Such an operational effect can be obtained also when, as shown in FIGS. 10 and 11, the diameter (width) of the pulverization chamber 13 is made larger in the direction perpendicular to the axial direction of the accelerating tube 1 from the accelerating tube outlet 10. FIG. 10 is a schematic cross section illustrating such another pneumatic impact pulverizer according to the second embodiment, and also shows a flow chart of a pulverization system in which the step of pulverization employing this pulverizer and the step of classification by means of a classifier are set up in combination. FIG. 11 is an enlarged view of another pneumatic impact pulverizer according to the second embodiment shown in FIG. 10.

In the pneumatic impact pulverizer of the present invention, the pulverization chamber 13 is made larger at the pulverization chamber upstream sidewall 15 than at the pulverization chamber downstream sidewall 16. Also, in order to more effectively carry out faster discharge of the pulverizing material from the pulverization chamber 13, a pneumatic impact pulverizer according to a third embodiment as shown in FIGS. 12 and 13 is preferred, in which the impact member 11 is made to have a conical shape having a specific vertical angle, at the side opposite to its impact face, i.e., the downstream side.

Figure 12:
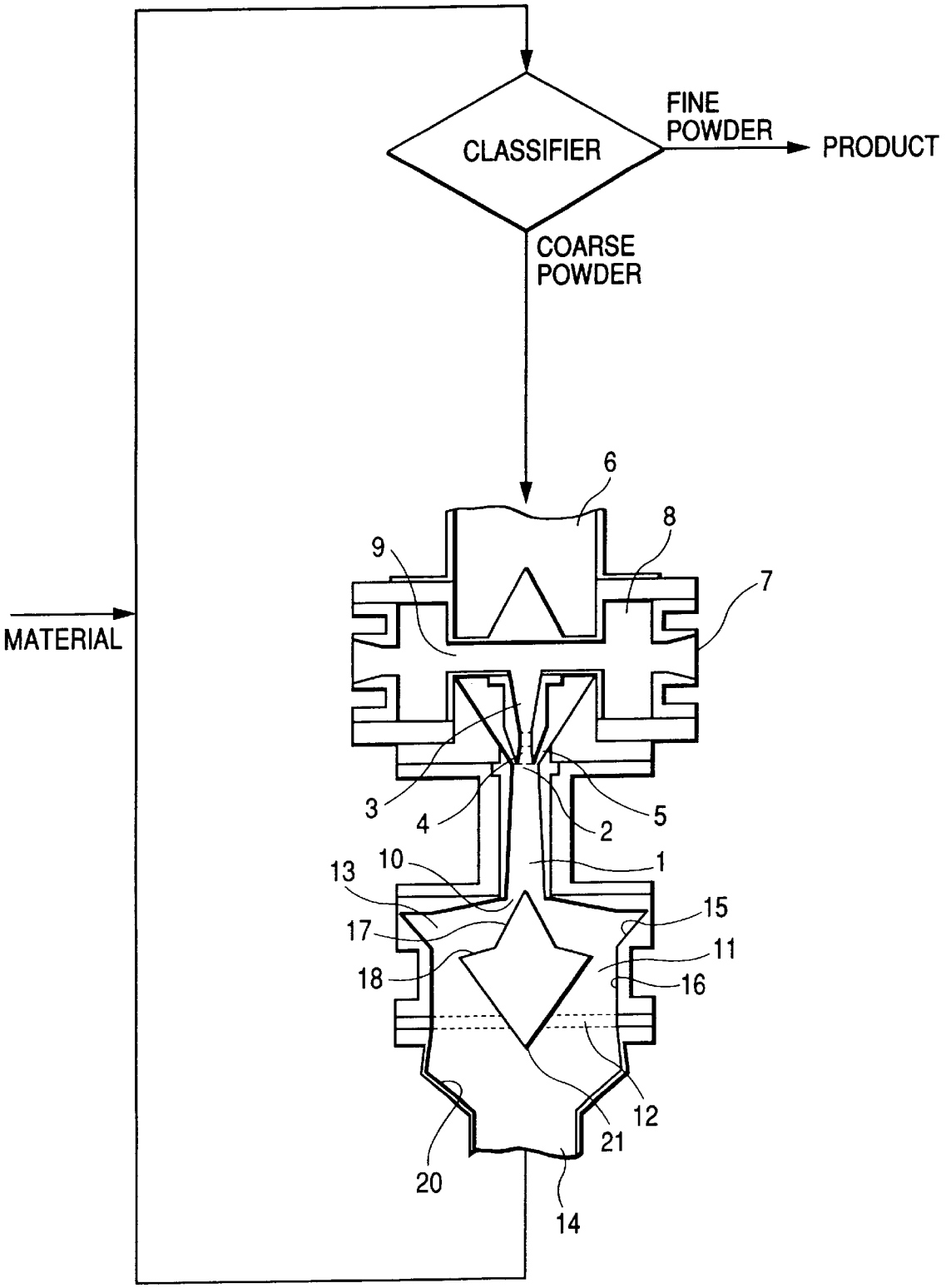
FIG. 12 is a schematic cross section illustrating a still further example of the pneumatic impact pulverizer according to the present invention.
Figure 13:
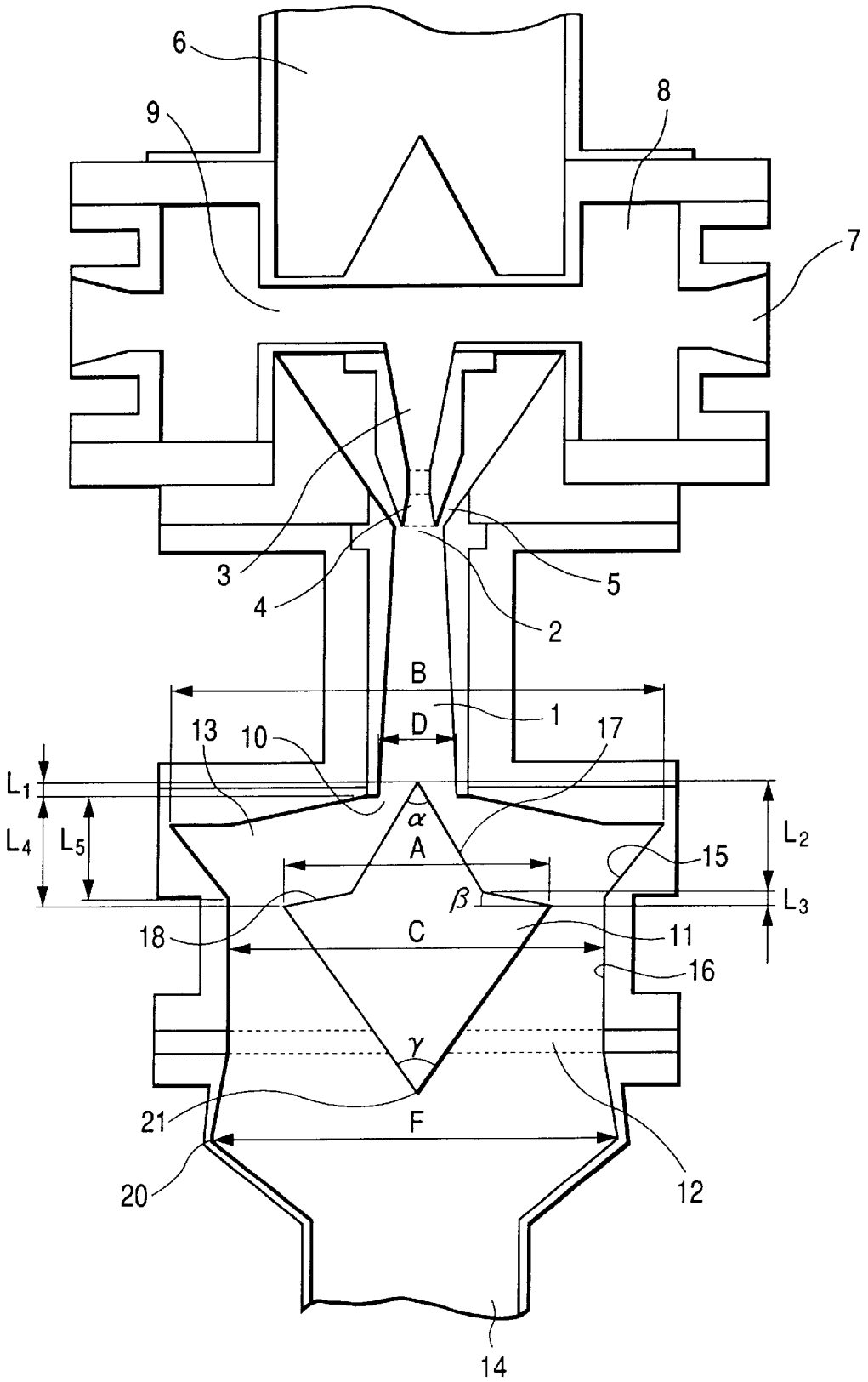
FIG. 13 is an enlarged view of the pulverizer shown in FIG. 12.

FIG. 12 is a schematic cross section illustrating the third embodiment of the pneumatic impact pulverizer according to the present invention, and also shows a flow chart of a pulverization system in which the step of pulverization employing this pulverizer and the step of classification by means of a classifier are set up in combination. FIG. 13 is an enlarged view of the pneumatic impact pulverizer shown in FIG. 12.

In the third embodiment of the pneumatic impact pulverizer according to the present invention, when the diameter across the outermost edge of the second impact face peripheral impact face 18 is represented by width A, the maximum diameter of the space formed by the upstream sidewall 15 of the pulverization chamber standing opposite to the impact member 11 by width B, and the minimum diameter of the space formed by the second-sidewall pulverization chamber downstream sidewall 16 by width C, the A, B and C may preferably satisfy the following relationship:

$C<B\leqq 1.6\times C$ $A<C<1.6\times A$ and may more preferably satisfy the following relationship:

$C<B\leqq 1.2\times C$ $A<C<1.5\times A.$

In the third embodiment of the pneumatic impact pulverizer according to the present invention, when the diameter of the accelerating tube outlet 10 is represented by D, the distance between the accelerating tube outlet 10 and the top of the projected central area 17, which is the first impact face of the impact member 11, by L1, the height of the projected central area 17 serving as the first impact face by L2, the height of the peripheral impact face 18 serving as the second impact face by L3, the distance between the outermost edge of the peripheral impact face 18 serving as the second impact face and the accelerating tube outlet 10 by L4, and the distance between the accelerating tube outlet 10 and the second-sidewall pulverization chamber downstream sidewall 16 by L5, the L1 to L5 may also preferably satisfy the following relationship:

$|L1|\leqq D/\{2\times\tan(\alpha/2)\}$ $L5\leqq L4\leqq L2+L3$ and may more preferably satisfy the following relationship:

$0<L1\leqq D/\{2\times\tan(\alpha/2)\}$ $L5\leqq L4\leqq L2+L3.$ (These height and distance are height and distance along the axial direction of the accelerating tube. When the tip of the projected central area 17 of the impact member 11 is positioned on the side more upstream than the accelerating tube outlet 10, L1 becomes plus. When on the other hand the tip of the projected central area 17 of the impact member 11 is positioned on the side more downstream than the accelerating tube outlet 10, L1 becomes minus.)

In the third embodiment of the pneumatic impact pulverizer according to the present invention, when the diameter of the most enlarged part (a front-zone pulverization chamber discharge outlet) 20 in the zone extending from the lowermost part of the pulverization chamber downstream sidewall 16 to the pulverized product discharge outlet 14 is represented by F, this diameter F and the width C representing the minimum diameter of the space formed by the second sidewall (the pulverization chamber downstream sidewall 16) may preferably satisfy the following relationship:

$F \geqq C$ and may more preferably satisfy the following relationship:

$F > C$.

If $C \geqq B$, the pressure loss in the vicinity of the accelerating tube outlet 10 increases to cause a decrease in the velocity of the high-pressure gas (solid-gas mixed stream) in the accelerating tube 1, so that the ejector effect at the accelerating tube throat 2 may lower to cause a decrease in suction quantity of the powder material and also the powder material may be insufficiently accelerated to bring about a weak impact force at the impact face of the impact member 11, resulting in a decrease in pulverization efficiency.

If $B > 1.6 \times C$, the powder material jetted out of the accelerating tube outlet 10 may become excessively expanded before it collides against the impact member 11, to cause a decrease in the flying velocity of the powder material in the vicinity of the impact face of the impact member 11 and bring about a weak impact force, resulting in a decrease in pulverization efficiency.

If $A \geqq C$, the flow path between the impact member 11 and the pulverization chamber downstream sidewall 16 is blocked at the outermost edge of the peripheral impact face 18.

If $1.6 \times A \leqq C$, the distance between the peripheral impact face 18 and the pulverization chamber downstream sidewall 16 is too large to attain effective third-order impact at the pulverization chamber downstream sidewall 16, resulting in a decrease in pulverization efficiency.

If $L1 < -D/\{2 \times \tan(\alpha/2)\}$, the impact member 11 is excessively distant from the accelerating tube outlet 10 to bring about a weak impact force, resulting in a decrease in pulverization efficiency.

If $L1 > D/\{2 \times \tan(\alpha/2)\}$, the accelerating tube outlet 10 is blocked with the projected central area 17 of the impact member 11.

What is meant by $0 < L1$ is that the tip of the first impact face projects into the accelerating tube 1. In this instance, the pulverization efficiency is more improved.

If $L5 > L4$, the second-order pulverized product second-order pulverized at the peripheral impact face 18 does not effectively third-order collide against the pulverization chamber downstream sidewall 16, resulting in a decrease in pulverization efficiency.

If $L4 > L2 + L3$, the peripheral impact face 18 is excessively distant from the accelerating tube outlet 10 to bring about a weak impact force, resulting in a decrease in pulverization efficiency.

If $F < C$, the pulverizer may undergo a back pressure to cause a decrease in discharge velocity of the pulverized product and an increase in the pulverized product stagnating in the pulverization chamber 13, resulting in a decrease in pulverization efficiency.

In the pneumatic impact pulverizer according to the third embodiment, the impact member 11 has at its back portion (downstream side) a projection with a conical shape, and this projection has a vertical angle $\gamma$ (degree) preferably satisfying the following relationship:

$0 < \gamma < 90$ and more preferably satisfying the following relationship:

$30 < \gamma < 90$.

Because of this feature, and concurrently with the feature that the wide, front-zone pulverization chamber discharge outlet 20 is provided, the back pressure in the vicinity of the front-zone pulverization chamber discharge outlet 20 can be made smaller, and the velocity of the solid-gas mixed stream can be increased at the zone of from the accelerating tube outlet 10 to the pulverized product discharge outlet 14, so that the pulverization can be carried out in a very good efficiency.

If $\gamma \geqq 90$, the front-zone pulverization chamber discharge outlet 20 has so small a volume that the pressure loss may increase in the vicinity of this outlet and hence the pulverized product can not be discharged with good efficiency.

In the pneumatic impact pulverizer of the present invention, the vertical angle $\alpha$ (degree) of the first impact face projected central area 17 of the impact member 11, projecting in a conical shape, and the angle $\beta$ (degree) of slope of the second impact face peripheral impact face 18 sloped toward the downstream side with respect to a perpendicular line formed toward the axis of the accelerating tube 1 may preferably satisfy the following relationship:

$0 < \alpha < 90,\ \beta > 0$ $30 \leqq (\alpha + 2\beta) \leqq 90$ and may more preferably satisfy the following relationship:

$0 < \alpha < 90,\ \beta > 0$ $50 \leqq (\alpha + 2\beta) \leqq 90$.

If the peripheral impact face 18 is not sloped toward the downstream side with respect to a perpendicular line formed toward the axis of the accelerating tube 1 and is vertical with respect to the axis of the accelerating tube 1 (i.e., an instance of $\beta = 0$), the flow reflected on the peripheral impact face 18 is directed to the solid-gas mixed stream jetted out of the accelerating tube outlet 10 to tend to cause a disturbance in the solid-gas mixed stream, and also the powder concentration becomes higher at the peripheral impact face 18 to tend to cause melt-deposits and agglomerates on the peripheral impact face 18 when a powder of thermoplastic resin or a powder chiefly composed of thermoplastic resin is used as the pulverizing material. Occurrence of such melt-deposits makes it difficult for the apparatus to be stably operated.

If $(\alpha + 2\beta) < 30$, the impact force of first-order pulverization at the projected central area 17 may be so weak as to tend to cause a decrease in pulverization efficiency.

If $(\alpha + 2\beta) > 90$, the first-order pulverized product first-order pulverized at the projected central area 17 does not effectively second-order collide against the peripheral impact face 18, and also the flow reflected on the peripheral impact face 18 strongly tends to be directed to the downstream side to bring about a weak impact force of the third-order pulverization at the pulverization chamber downstream sidewall 16, tending to cause a decrease in pulverization efficiency.

As described above, according to the pneumatic impact pulverizer of the present invention, in which the impact member having a specific shape is used, the positional relationship between the accelerating tube outlet and the impact member is specified and the shapes of the pulverization chamber inner walls are specified, the powder material can be pulverized in a very high efficiency. More specifically, the pulverizing material jetted out of the accelerating tube outlet 10 under a low back pressure of the pulverization chamber 13 in the vicinity of the accelerating tube outlet 10 and in a rapidly accelerated state is first-order, second-order and third-order pulverized at a great impact force attributable to the impact member 11, thus the pulverization efficiency can be improved.

Figure 14:
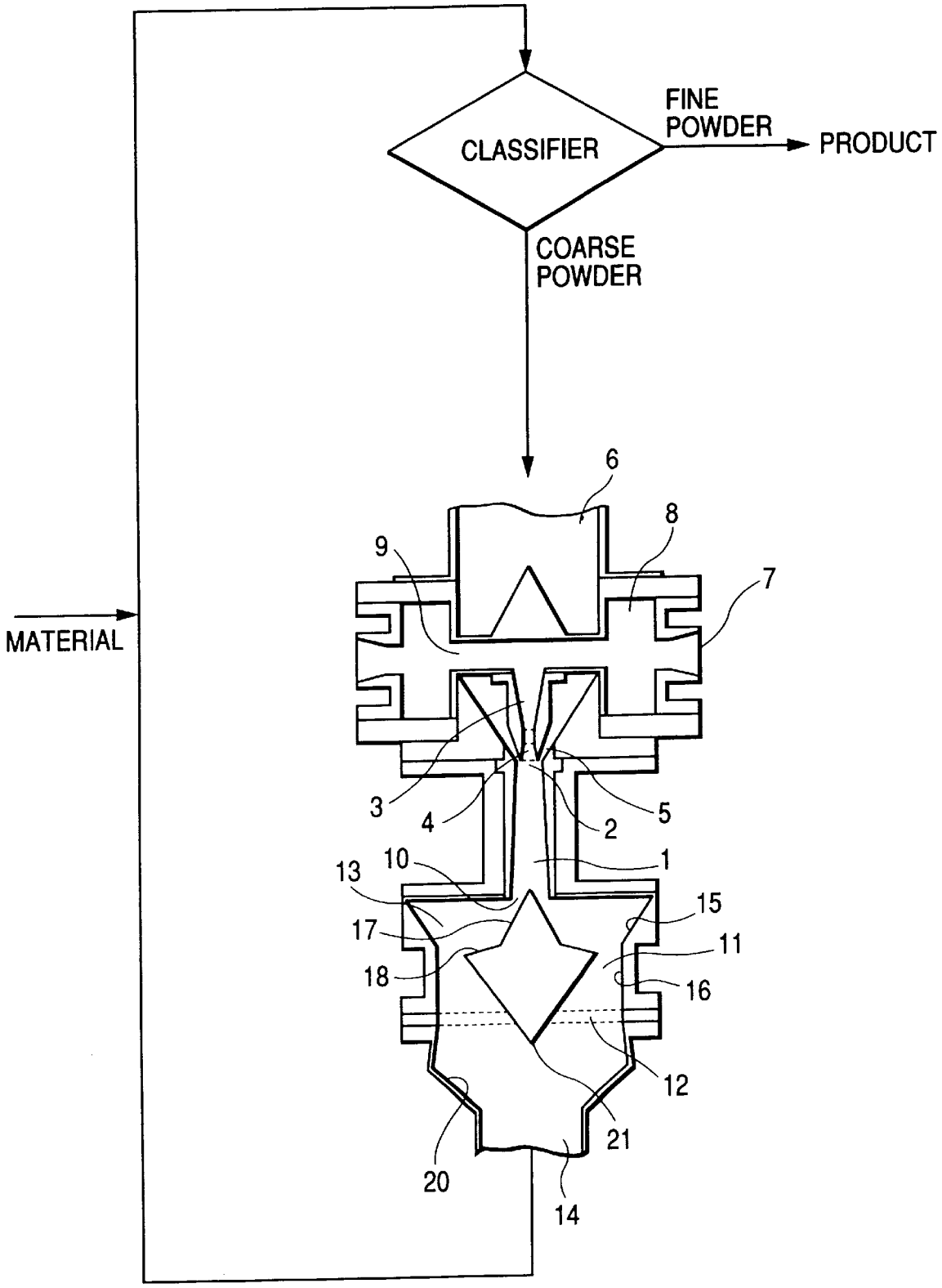
FIG. 14 is a schematic cross section illustrating a still further example of the pneumatic impact pulverizer according to the present invention.
Figure 15:
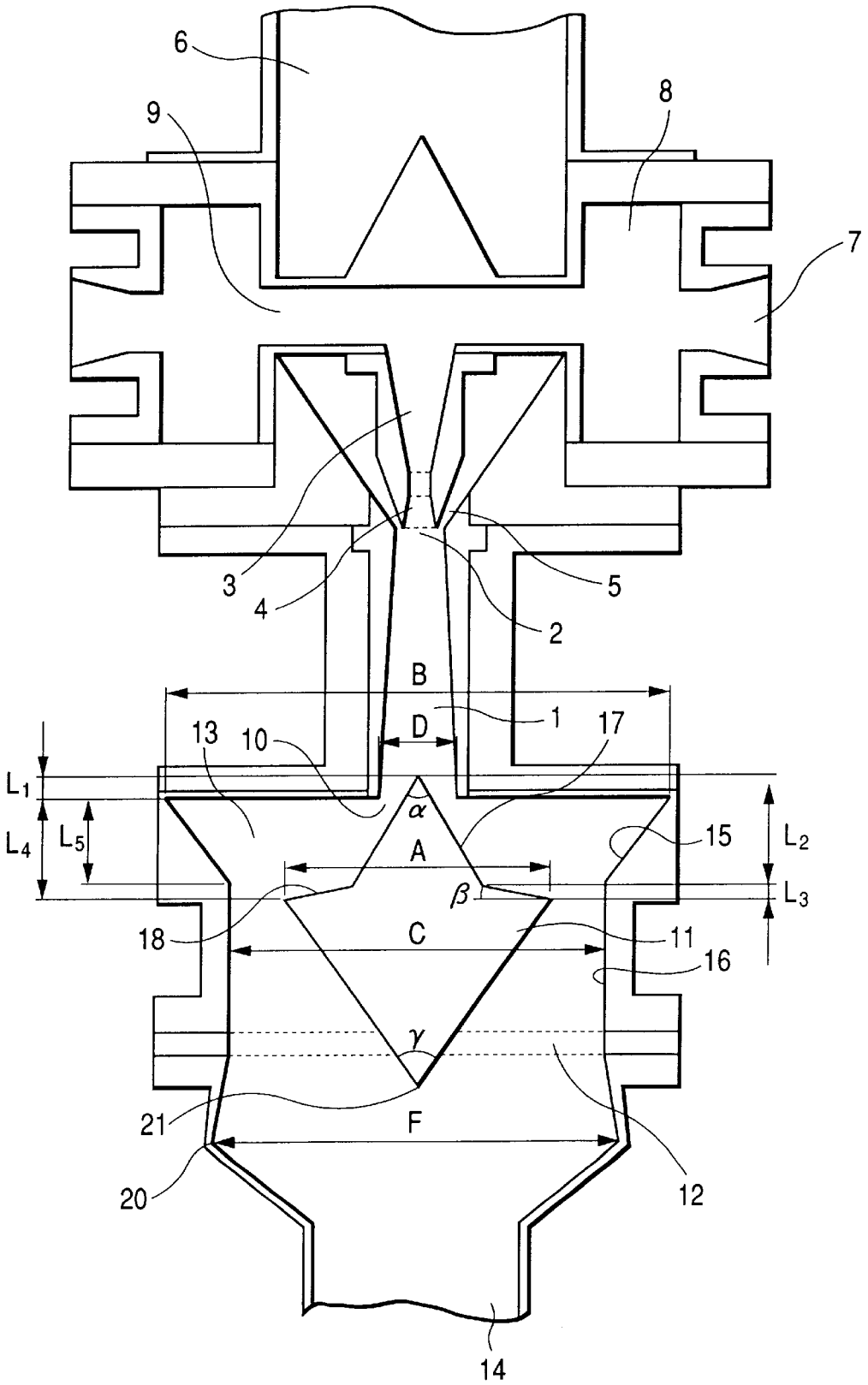
FIG. 15 is an enlarged view of the pulverizer shown in FIG. 14.

Such an operational effect can be obtained also when, as shown in FIGS. 14 and 15, the diameter (width) of the pulverization chamber 13 is made larger in the direction perpendicular to the axial direction of the accelerating tube 1 from the accelerating tube outlet 10. FIG. 14 is a schematic cross section illustrating such a pneumatic impact pulverizer according to the third embodiment, and also shows a flow chart of a pulverization system in which the step of pulverization employing this pulverizer and the step of classification by means of a classifier are set up in combination. FIG. 15 is an enlarged view of the pneumatic impact pulverizer according to the third embodiment shown in FIG. 14.

In the pneumatic impact pulverizers according the first to third embodiments described above, the accelerating tube 1 may preferably be so provided that its inclination in the axial direction on the basis of the vertical line may preferably be at 0 to 45°, more preferably at 0 to 20°, and still more preferably at 0 to 5° in substantially the vertical direction.

If the inclination of the accelerating tube in the axial direction is greater than 45°, the pulverizing material may be stalled to become clogged in the accelerating tube 1 undesirably.

The process for producing a toner according to the present invention will be described below.

The process for producing a toner according to the present invention comprises the steps of;

melt-kneading a mixture containing at least a binder resin and a colorant, to obtain a kneaded product;

cooling the resultant kneaded product to solidify;

crushing the resultant cooled kneaded product to obtain a crushed product; and pulverizing the resultant crushed product by means of the pneumatic impact pulverizer of the present invention.

In the process for producing a toner according to the present invention, in addition to the binder resin and the colorant, toner materials including charge control agents and waxes are optionally mixed by means of a mixing machine.

As the mixing machine, Henschel mixer, Super mixer (Kawata K.K.) or Loedige mixer (Loedige Co.) may be used, and the mixing may preferably be carried out for 1 to 10 minutes.

The mixture obtained through the above mixing step is melt-kneaded by means of a kneading machine.

As the kneading machine, PCM, TEM (Toshiba Machine Co., Ltd.) or TEX (Nippon Seiko K.K.) may be used, and the melt-kneading may preferably be carried out at a kneading resin temperature of from 100° C. to 200° C., and preferably from 100° C. to 160° C.

The kneaded product obtained through the above kneading step is cooled to 40° C. or below to solidify, by means of a cooling roll, a cooling conveyor drum or a cooler, using cooling water of 30° C. or below. The solidified product obtained through the above cooling and solidifying step is crushed by means of a mechanical crusher.

As the mechanical crusher, a crusher mill, a hammer mill or a roller mill may be used.

In this crushing step, in order to prevent the pulverizing material feed opening 5 from clogging, the crushing may preferably be carried out so that the crushed product has a 50% particle diameter of from 200 to 20,000 μm.

The crushed product obtained through the above crushing step is finely ground by means of the pneumatic impact pulverizer of the present invention.

The finely ground product obtained through the above finely grinding step is classified by means of a classifier.

As the classifier, Turbo classifier (Nisshin Flour Milling Co., Ltd.), Donaselec (Japan Donaldson Co.) or Triplone (Mitsui Miike Engineering Corporation) may be used.

The classified product obtained through the above classification step may preferably have a weight average particle diameter of from 3 to 15 μm, more preferably from 4 to 12 μm, and still more preferably from 5 to 10 μm, in view of resolution and gradation of the images to be formed.

The classified product obtained through the above classification step may be optionally mixed with external additives.

As a mixing machine used for the mixing with the external additives, Henschel mixer, Super mixer or Loedige mixer may be used.

As the binder resin used in the present invention, any known binder resins may be used. For example, it may include polystyrene; homopolymers of styrene substitution products, such as poly-p-chlorostyrene and polyvinyltoluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; maleic acid resins, acrylic resins, methacrylic resins, silicone resins, polyester resins, polyamide resins, furan resins, epoxy resins and xylene resins. In particular, styrene copolymers, polyester resins and epoxy resins are preferred resins.

Comonomers copolymerizable with styrene monomers in the styrene copolymers may include vinyl monomers including monocarboxylic acids having a double bond and substitution products thereof such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and substitution products thereof such as maleic acid, butyl maleate, methyl maleate and dimethyl maleate; vinyl esters such as vinyl chloride, vinyl acetate and vinyl benzoate; olefins such as ethylene, propylene and butylene; vinyl ketones such as methyl vinyl ketone and hexyl vinyl ketone; and vinyl ethers such as methyl vinyl ether, ethyl vinyl ether and isobutyl vinyl ether. Any of these vinyl monomers may be used alone or in combination of two or more. As cross-linking agents, compounds having at least two polymerizable double bonds may be used. For example, they include aromatic divinyl compounds such as divinyl benzene and divinyl naphthalene; carboxylic acid esters having two double bonds such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these may be used alone or in the form of a mixture.

As the colorant used in the present invention, inorganic pigments, organic dyes and organic pigments may be used.

Black colorants may include carbon black, magnetic materials such as magnetite and ferrite, and those color-toned in black by the use of yellow, magenta and cyan colorants.

A non-magnetic black colorant such as carbon black may be used in an amount of from 1 to 20 parts by weight based on 100 parts by weight of the binder resin.

As a magnetic material, it may include metal oxides chiefly composed of iron element and containing as an optional component an element such as cobalt, nickel, copper, magnesium or manganese. In particular, magnetic materials chiefly composed of triiron tetraoxide and γ-iron oxide are preferred. From the viewpoint of controlling chargeability of magnetic toners, the magnetic material may also contain silicon element or another metal element such as aluminum element. Such a magnetic material may have a BET specific surface area, as measured by nitrogen gas absorption, of from 2 to 30 $m^2/g$, and particularly from 3 to 28 $m^2/g$. The magnetic material may preferably be a magnetic material having a Mohs hardness of from 5 to 7.

As the form of the magnetic material, octahedral, hexahedral or spherical ones with less anisotropy are preferred in view of an improvement in image density. The magnetic material may preferably have a number average particle diameter of from 0.05 to 1.0 μm, more preferably from 0.1 to 0.6 μm, and still more preferably from 0.1 to 0.4 μm.

The magnetic material may preferably be in a content of from 30 to 200 parts by weight, preferably from 40 to 200 parts by weight, and more preferably from 50 to 150 parts by weight, based on 100 parts by weight of the binder resin. If it is in a content less than 30 parts by weight, when used in a developing assembly making use of a magnetic force for the transport of toner, the transport performance may lower to tend to make the toner layer on the toner carrying member uneven, and also the quantity of triboelectricity may increase to tend to cause a decrease in image density. On the other hand, if it is in a content more than 200 parts by weight, the fixing performance of the magnetic toner may lower.

As yellow colorants, compounds as typified by condensation azo compounds, isoindolinone compounds, anthraquinone compounds, azo metal complexes, and methine compounds may be used. Stated specifically, C.I. Pigment Yellow 12, 13, 14, 15, 17, 62, 74, 83, 93, 94, 95, 97, 109, 110, 111, 120, 127, 128, 129, 147, 168, 174, 176, 180, 181, 191, etc. may preferably be used.

As magenta colorants, condensation azo compounds, diketopyrroropyrrole compounds, anthraquinone compounds, quinacridone compounds, basic dye lake compounds, naphthol compounds, benzimidazolone compounds, thioindigo compounds and perylene compounds may be used. Stated specifically, C.I. Pigment Red 2, 3, 5, 6, 7, 23, 48:2, 48:3, 48:4, 57:1, 81:1, 144, 146, 166, 169, 177, 184, 185, 202, 206, 220, 221 and 254 are particularly preferred.

As cyan colorants, copper phthalocyanine compounds and derivatives thereof, anthraquinone compounds and basic dye lake compounds may be used. Stated specifically, C.I. Pigment Blue 1, 7, 15, 15:1, 15:2, 15:3, 15:4, 60, 62, 66, etc. may preferably be used.

Any of these non-magnetic chromatic colorants may be used alone, in the form of a mixture or in the state of a solid solution. The chromatic colorant may be selected in view of hue angles, chromaticity, brightness, weatherability, OHP transparency, and dispersibility in toners. The chromatic colorant may preferably be used in an amount of from 1 to 20 parts by weight based on 100 parts by weight of the binder resin.

For the purposes of improving releasability from fixing means at the time of fixing and improving fixing performance, wax may be incorporated in toner particles. The wax may include paraffin wax and derivatives thereof, microcrystalline wax and derivatives thereof, Fischer-Tropsch wax and derivatives thereof, polyolefin wax and derivatives thereof, and ester wax and derivatives thereof. The derivatives may include oxides, block copolymers with vinyl monomers, and graft modified products.

In the toner, a charge control agent may preferably be used by compounding it into magnetic toner particles (internal addition) or blending it with magnetic toner particles (external addition). The charge control agent enables control of optimum charge quantity in conformity with developing systems. In particular, it can make more stable the balance between particle size distribution and charge quantity. As those capable of controlling the toner to be negatively chargeable, organic metal complexes or chelate compounds are used. For example, they include monoazo metal complexes, acetylacetone metal complexes, aromatic hydroxycarboxylic acid metal complexes and aromatic dicarboxylic acid metal complexes. Besides, they include aromatic hydroxycarboxylic acids, aromatic mono- or polycarboxylic acids and metal salts, anhydrides or esters thereof, and phenol derivatives such as bisphenol.

Those capable of controlling the toner to be positively chargeable include Nigrosine and products modified with a fatty acid metal salt; quaternary ammonium salts such as tributylbenzylammonium 1-hydroxy-4-naphthoslulfonate and tetrabutylammonium teterafluoroborate, onium salts such as phosphonium salts and lake pigments of these; triphenylmethane dyes and lake pigments of these (lake-forming agents may include tungstophosphoric acid, molybdophosphoric acid, tungstomolybdophosphoric acid, tannic acid, lauric acid, gallic acid, ferricyanides and ferrocyanides); metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate. Any of these may be used alone or in combination of two or more.

The charge control agents described above may preferably be used in the form of fine particles. In such an instance, these charge control agents may preferably have a number average particle diameter of 4 μm or smaller, and particularly preferably 3 μm or smaller. In the case when the charge control agent is internally added to toner particles, it may preferably be used in an amount of from 0.1 to 20 parts by weight, and particularly from 0.2 to 10 parts by weight, based on 100 parts by weight of the binder resin.

For the purpose of improving the properties of toner, it is preferable to mix an external additive in toner particles.

The external additive may include inorganic fine powder. As the inorganic fine powder, silica, alumina and titania or double oxides thereof are preferred in order to improve charging stability, developing performance, fluidity and storage stability. The silica includes what is called dry-process silica or fumed silica, produced by vapor phase oxidation of silicon halides or alkoxides, and wet-process silica produced from alkoxides, water glass or the like, either of which may be used. The dry-process silica is preferred, as having less silanol groups on the surface and inside of fine silica powder and leaving less production residue such as $Na_2O$ and $SO_3^{2-}$. In the dry-process silica, it is also possible to use, in its production step, other metal halide such as aluminum chloride or titanium chloride together with the silicon halide to obtain a composite fine powder of silica with other metal oxide. Such a powder may also be used.

The inorganic fine powder may preferably have a BET specific surface area of 30 $m^2/g$ or more, and particularly in the range of from 50 to 400 $m^2/g$, as measured by the BET method using nitrogen gas absorption. Such a powder provides good results. The inorganic fine powder may be used in an amount of from 0.1 to 8 parts by weight, preferably from 0.5 to 5 parts by weight, and more preferably from 1.0 to 3.0 parts by weight, based on 100 parts by weight of the toner particles.

The inorganic fine powder may preferably have a primary average particle diameter of 30 nm or smaller.

If necessary, for the purpose of making hydrophobic or controlling chargeability, the inorganic fine powder may preferably be treated with a treating agent such as silicone varnish, modified silicone varnish of various types, silicone oil, modified silicone oil, a silane coupling agent, a slilane coupling agent with a functional group, and other organic silicon compound or organic titanium compound. It is also preferable to use the treating agent in plurality to treat the inorganic fine powder.

In order to maintain a high charge quantity and achieve a high transfer efficiency, the inorganic fine powder may more preferably be treated with at least the silicone oil.

In order to improve transfer performance and/or cleanability, it is also preferable to produce the toner with further addition of, in addition to the inorganic fine powder, inorganic or organic substantially spherical fine particles having primary particle diameters of 30 nm or larger (preferably having a specific surface area of less than 50 $m^2/g$), and more preferably 50 nm or larger (preferably having a specific surface area of less than 30 $m^2/g$). For example, spherical silica particles, spherical polymethylsesquioxane particles or spherical resin particles are preferably used.

In the toner particles, other external additives may be further externally added so long as they substantially do not adversely affect the toner particles. They may include, for example, lubricant powders such as Teflon powder, zinc stearate powder and polyvinylidene fluoride powder; abrasives such as cerium oxide powder, silicon carbide powder, calcium titanate powder and strontium titanate powder; anti-caking agents; conductivity-providing agents such as carbon black powder, zinc oxide powder and tin oxide powder; and organic particles and inorganic particles with polarity reverse to that of the toner particles.

The toner produced by the toner production process of the present invention is used as a one component type developer as it is, or is blended with carrier particles so as to be used as a two component type developer.

As described above, according to the pneumatic impact pulverizer of the present invention, the pulverizing material is introduced into the accelerating tube in a dispersed state so as to be free from uneven powder concentration and also the pulverization chamber is appropriately enlarged at the accelerating tube outlet so that the back pressure in the vicinity of the accelerating tube outlet can be lowered, and the impact member is set close to the accelerating tube so that the solid-gas mixed stream appropriately accelerated and expanded can be jetted out in a well dispersed state and at a great impact energy toward the impact member set opposite to the accelerating tube outlet, where the pulverizing material is first-order pulverized at the conical projected central area provided on the impact member, further second-order pulverized at the peripheral impact face provided around the projected central area, and thereafter third-order pulverized at the pulverization chamber downstream sidewall. Hence, compared with conventional pneumatic impact pulverizers, the pulverization efficiency can be greatly improved and also the product obtained under equally controlled throughput capacity can be made to have smaller particle diameters.

Since the pulverizing material collides against the impact face of the impact member in a dispersed state, the pulverized product can be prevented from melt-adhering, agglomerating and being formed in coarse particles and the inner walls of the accelerating tube and the impact faces of the impact member can be prevented from being locally worn, to enable stable operation, especially when a powder chiefly composed of thermoplastic resin is used as the pulverizing material. Also, the pulverizing material can be prevented from being excessively pulverized, and a finely ground product with a sharp particle size distribution can be obtained.

According to the pneumatic impact pulverizer of the present invention, resin particles with a 50% particle diameter of from 200 to 2,000 $\mu$m can be pulverized into particles with a weight average particle diameter of from 3 to 15 $\mu$m in a good efficiency. Thus, the toner for developing electrostatic images which is sought to have smaller particle diameters can be obtained in a good efficiency.

EXAMPLES

Examples of the production of toners by means of pulverizers of the present invention and Comparative Examples of the production of toners by means of conventional pulverizers are given below.

Example 1

| | |
|---|---|
| Styrene-butyl acrylate-divinylbenzene copolymer (monomer copolymerization ratio: 80:19:1; Mw: 350,000) | 100 parts |
| Magnetic iron oxide (average particle diameter: 0.18 $\mu$m) | 100 parts |
| Nigrosine | 2 parts |
| Low-molecular weight ethylene-propylene copolymer | 4 parts |
| | (all by weight) |

The materials formulated as shown above were thoroughly mixed using a Henschel mixer Model FM-75 (manufactured by Mitsui Miike Engineering Corporation), and thereafter the mixture obtained was melt-kneaded using a twin-screw extruder Model PCM-30 (manufactured by Ikegai Corp.) heated to 150° C. The kneaded product obtained was cooled, and then crushed with a hammer mill into particles with a 50% particle diameter of 1 mm or smaller to obtain a toner pulverizing material. The pulverizing material thus obtained was pulverized by means of the pneumatic impact pulverizer shown in FIGS. 1 and 2.

In the pneumatic impact pulverizer, the tip of the projected central area of the impact member, projected into the accelerating tube, is positioned at 10 mm from the accelerating tube outlet (L1=10 mm), the diameter of the space formed by the pulverization chamber upstream sidewall is 154 mm (B=154 mm), and the diameter of the space formed by the pulverization chamber downstream sidewall is 136 mm (C=136 mm). Thus, the cross-sectional area of the inside of the pulverization chamber at its pulverization chamber upstream sidewall 15 was larger than the cross-sectional area of the inside of the pulverization chamber at its pulverization chamber downstream sidewall 16 corresponding to the outermost edge of the second impact face. The projected central area 17 of the impact member 11 has a conical shape with a vertical angle of 55° ($\alpha$=55°) and the peripheral impact face 18 has a slope angle of 10° ($\beta$=10°) with respect to the axis of the accelerating tube 1. Therefore, ($\alpha+2\beta$) is 75°.

The pulverizing material was fed to a forced vortex type air classifier by means of a constant-rate feeder at a rate of 54 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 8.0 $\mu$m was obtained as a classified fine powder. No melt-deposits occurred on the impact member of the pneumatic impact pulverizer to have enabled stable operation.

The classified product thus obtained was mixed with fine silica powder treated with amino-modified silicone oil, to obtain a positively chargeable toner. The toner was used in a commercially available laser beam printer LBP-450 (manufactured by CANON INC.) to form images. As a result, good images were obtained.

The particle size distribution of the finely ground product can be measured by various methods. In the present invention, it is measured using a Coulter counter.

More specifically, Coulter counter Model TA-II (manufactured by Coulter Electronics, Inc.) is used, and an interface (manufactured by Nikkaki k.k.) that outputs number distribution and volume distribution and a CX-1 personal computer (manufactured by CANON INC.) are connected. As an electrolytic solution, an aqueous 1% NaCl solution is prepared using first-grade sodium chloride. Measurement is made by adding as a dispersant from 0.1 to 5 ml of a surface-active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. The number-based, particle size distribution of particles with diameters of 2 to 40 $\mu$m is measured by means of the above Coulter counter Model TA-II, using an aperture of 100 $\mu$m as its aperture. Then the volume-based, weight average particle diameter determined from volume distribution is determined.

To measure the 50% particle diameter of the crushed product, standard sieves are multi-stage superposed, and weights of particles remaining on the individual sieves are measured, on the basis of which a partial separation efficiency curve is formed to determine the 50% particle diameter (D50).

Example 2

Using the same toner pulverizing material as in Example 1, it was pulverized by means of the pneumatic impact pulverizer shown in FIG. 6.

In the pneumatic impact pulverizer, the tip of the projected central area of the impact member, projected into the accelerating tube, is positioned at 10 mm from the accelerating tube outlet (L1=10 mm), the diameter of the space formed by the pulverization chamber upstream sidewall is 154 mm (B=154 mm), and the diameter of the space formed by the pulverization chamber downstream sidewall is 136 mm (C=136 mm). Thus, the cross-sectional area of the inside of the pulverization chamber at its pulverization chamber upstream sidewall 15 was larger than the cross-sectional area of the inside of the pulverization chamber at its pulverization chamber downstream sidewall 16 corresponding to the outermost edge of the second impact face. The projected central area 17 of the impact member 11 has a conical shape with a vertical angle of 55° ($\alpha$=55°) and the peripheral impact face 18 has a slope angle of 10° ($\beta$=10°) with respect to the axis of the accelerating tube 1. Therefore, ($\alpha$+2$\beta$) is 75°.

The pulverizing material was fed to a forced vortex type air classifier by means of a constant-rate feeder at a rate of 53 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 8.1 $\mu$m was obtained as a classified fine powder. No melt-deposits occurred on the impact member of the pneumatic impact pulverizer to have enabled stable operation.

Example 3

Using the same toner pulverizing material as in Example 1, it was pulverized by means of the pneumatic impact pulverizer shown in FIG. 1. The pneumatic impact pulverizer has the same construction as that used in Example 1.

The pulverizing material was fed to a forced vortex type air classifier by means of a constant-rate feeder at a rate of 36 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 6.0 $\mu$m was obtained as a classified fine powder. No melt-deposits occurred on the impact member of the pneumatic impact pulverizer to have enabled stable operation.

Example 4

Using the same toner pulverizing material as in Example 1, it was pulverized by means of the pneumatic impact pulverizer shown in FIG. 6. The pneumatic impact pulverizer has the same construction as that used in Example 2.

The pulverizing material was fed to a forced vortex type air classifier by means of a constant-rate feeder at a rate of 35 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 6.1 $\mu$m was obtained as a classified fine powder. No melt-deposits occurred on the impact member of the pneumatic impact pulverizer to have enabled stable operation.

Example 5

Using the same toner pulverizing material as in Example 1, it was pulverized by means of the pneumatic impact pulverizer as shown in FIG. 1.

In the pneumatic impact pulverizer, the projected central area of the impact member is not projected into the accelerating tube and its tip is positioned at −5 mm from the accelerating tube outlet (L1=−5 mm), the diameter of the space formed by the pulverization chamber upstream sidewall is 154 mm (B=154 mm), and the diameter of the space formed by the pulverization chamber downstream sidewall is 136 mm (C=136 mm). Thus, the cross-sectional area of the inside of the pulverization chamber at its pulverization chamber upstream sidewall 15 was larger than the cross-sectional area of the inside of the pulverization chamber at its pulverization chamber downstream sidewall 16 corresponding to the outermost edge of the second impact face. The projected central area 17 of the impact member 11 has a conical shape with a vertical angle of 55° ($\alpha$=55°) and the peripheral impact face 18 has a slope angle of 10° ($\beta$=10°) with respect to the axis of the accelerating tube 1. Therefore, ($\alpha$+2$\beta$) is 75°.

The pulverizing material was fed to a forced vortex type air classifier by means of a constant-rate feeder at a rate of 52 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 8.1 $\mu$m was obtained as a classified fine powder.

Example 6

Using the same toner pulverizing material as in Example 1, it was pulverized by means of the pneumatic impact pulverizer shown in FIG. 1. The pneumatic impact pulverizer has the same construction as that used in Example 5.

The pulverizing material was fed to a forced vortex type air classifier by means of a constant-rate feeder at a rate of 34 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 6.1 $\mu$m was obtained as a classified fine powder. No melt-deposits occurred on the impact member of the pneumatic impact pulverizer to have enabled stable operation.

Example 7

Using the same toner pulverizing material as in Example 1, it was pulverized by means of the pneumatic impact pulverizer as shown in FIG. 1.

In the pneumatic impact pulverizer, the tip of the projected central area of the impact member, projected into the accelerating tube, is positioned at 10 mm from the accelerating tube outlet (L1=10 mm), the diameter of the space formed by the pulverization chamber upstream sidewall is 154 mm (B=154 mm), and the diameter of the space formed by the pulverization chamber downstream sidewall is 136 mm (C=136 mm). Thus, the cross-sectional area of the inside of the pulverization chamber at its pulverization chamber upstream sidewall 15 was larger than the cross-sectional area of the inside of the pulverization chamber at its pulverization chamber downstream sidewall 16 corresponding to the outermost edge of the second impact face. The projected central area 17 of the impact member 11 has a conical shape with a vertical angle of 65° ($\alpha$=65°) and the peripheral impact face 18 has a slope angle of 15° ($\beta$=15°) with respect to the axis of the accelerating tube 1. Therefore, ($\alpha$+2$\beta$) is 95°.

The pulverizing material was fed to a forced vortex type air classifier by means of a constant-rate feeder at a rate of 50 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 8.1 $\mu$m was obtained as a classified fine powder. No melt-deposits occurred on the impact member of the pneumatic impact pulverizer to have enabled stable operation, but, when the pulverizing material was fed in a quantity larger than 50 kg/h, the fine powder obtained came to have a larger weight average particle diameter.

Example 8

Using the same toner pulverizing material as in Example 1, it was pulverized by means of the pneumatic impact pulverizer shown in FIG. 1. The pneumatic impact pulverizer has the same construction as that used in Example 7.

The pulverizing material was fed to a forced vortex type air classifier by means of a constant-rate feeder at a rate of 33 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 6.1 $\mu$m was obtained as a classified fine powder. No melt-deposits occurred on the impact member of the pneumatic impact pulverizer to have enabled stable operation, but, when the pulverizing material was fed in a quantity larger than 33 kg/h, the fine powder obtained came to have a larger weight average particle diameter.

Example 9

Using the same toner pulverizing material as in Example 1, it was pulverized by means of the pneumatic impact pulverizer as shown in FIG. 8.

In the pneumatic impact pulverizer, the tip of the projected central area of the impact member, projected into the accelerating tube, is positioned at 10 mm from the accelerating tube outlet (L1=10 mm), the diameter of the space formed by the pulverization chamber upstream sidewall 15 is 154 mm (B=154 mm), the diameter of the space formed by the pulverization chamber downstream sidewall 16 is 136 mm (C=136 mm), the diameter of the space formed by the pulverization chamber impact wall 19 at its innermost edge is 132 mm (E=132 mm), the distance between the outermost edge of the second impact face of the impact member and the innermost edge of the pulverization chamber impact wall is 35 mm (L6=35 mm), and the angle of the pulverization chamber impact wall 19 that is formed with respect to the axis of the accelerating tube 1 is 8° ($\theta$=8°). The projected central area 17 of the impact member 11 has a conical shape with a vertical angle of 55° ($\alpha$=55°) and the peripheral impact face 18 has a slope angle of 10° ($\beta$=10°) with respect to the axis of the accelerating tube 1. Therefore, ($\alpha$+2$\beta$) is 75°. Thus, the cross-sectional area of the inside of the pulverization chamber on its upstream side was larger than the cross-sectional area of the inside of the pulverization chamber corresponding to the outermost edge of the second impact face.

The pulverizing material was fed to a forced vortex type air classifier by means of a constant-rate feeder at a rate of 52 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 8.0 $\mu$m was obtained as a classified fine powder. No melt-deposits occurred on the impact member of the pneumatic impact pulverizer to have enabled stable operation.

The classified product obtained was mixed with fine silica powder treated with amino-modified silicone oil in the same manner as in Example 1, to obtain a positively chargeable toner, and images were similarly formed using this toner. As a result, good images were obtained.

Example 10

Using the same toner pulverizing material as in Example 1, it was pulverized by means of the pneumatic impact pulverizer shown in FIG. 10.

In the pneumatic impact pulverizer, the tip of the projected central area of the impact member, projected into the accelerating tube, is positioned at 10 mm from the accelerating tube outlet (L1=10 mm), the diameter of the space formed by the pulverization chamber upstream sidewall 15 is 154 mm (B=154 mm), the diameter of the space formed by the pulverization chamber downstream sidewall 16 is 136 mm (C=136 mm), the diameter of the space formed by the pulverization chamber impact wall 19 at its innermost edge is 132 mm (E=132 mm), the distance between the outermost edge of the second impact face of the impact member and the innermost edge of the pulverization chamber impact wall is 35 mm (L6=35 mm), and the angle of the pulverization chamber impact wall 19 that is formed with respect to the axis of the accelerating tube 1 is 8° ($\theta$=8°). The projected central area 17 of the impact member 11 has a conical shape with a vertical angle of 55° ($\alpha$=55°) and the peripheral impact face 18 has a slope angle of 10° ($\beta$=10°) with respect to the axis of the accelerating tube 1. Therefore, ($\alpha$+2$\beta$) is 75°. Thus, the cross-sectional area of the inside of the pulverization chamber on its upstream side was larger than the cross-sectional area of the inside of the pulverization chamber corresponding to the outermost edge of the second impact face.

The pulverizing material was fed to a forced vortex type air classifier by means of a constant-rate feeder at a rate of 51 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 8.1 $\mu$m was obtained as a classified fine powder. No melt-deposits occurred on the impact member of the pneumatic impact pulverizer to have enabled stable operation.

Example 11

Using the same toner pulverizing material as in Example 1, it was pulverized by means of the pneumatic impact pulverizer shown in FIG. 8. The pneumatic impact pulverizer has the same construction as that used in Example 9.

The pulverizing material was fed to a forced vortex type air classifier by means of a constant-rate feeder at a rate of 34 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 6.0 $\mu$m was obtained as a classified fine powder. No melt-deposits occurred on the impact member of the pneumatic impact pulverizer to have enabled stable operation.

Example 12

Using the same toner pulverizing material as in Example 1, it was pulverized by means of the pneumatic impact pulverizer shown in FIG. 10. The pneumatic impact pulverizer has the same construction as that used in Example 10.

The pulverizing material was fed to a forced vortex type air classifier by means of a constant-rate feeder at a rate of 33 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 6.1 $\mu$m was obtained as a classified fine powder. No melt-deposits occurred on the impact member of the pneumatic impact pulverizer to have enabled stable operation.

Example 13

Using the same toner pulverizing material as in Example 1, it was pulverized by means of the pneumatic impact pulverizer as shown in FIG. 8.

In the pneumatic impact pulverizer, the projected central area of the impact member is not projected into the accelerating tube and its tip is positioned at −5 mm from the accelerating tube outlet (L1=−5 mm), the diameter of the space formed by the pulverization chamber upstream sidewall is 154 mm (B=154 mm), the diameter of the space formed by the pulverization chamber downstream sidewall is 136 mm (C=136 mm), and the distance between the outermost edge of the second impact face of the impact member and the innermost edge of the pulverization chamber impact wall is 35 mm (L6=35 mm). The projected central area 17 of the impact member 11 has a conical shape with a vertical angle of 55° ($\alpha$=55°) and the peripheral impact face 18 has a slope angle of 10° ($\beta$=10°) with respect to the axis of the accelerating tube 1. Therefore, ($\alpha$+2$\beta$) is 75°. Thus, the cross-sectional area of the inside of the pulverization chamber on its upstream side was larger than the cross-sectional area of the inside of the pulverization chamber corresponding to the outermost edge of the second impact face.

The pulverizing material was fed to a forced vortex type air classifier by means of a constant-rate feeder at a rate of 48 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 8.1 $\mu$m was obtained as a classified fine powder. No melt-deposits occurred on the impact member of the pneumatic impact pulverizer to have enabled stable operation.

Example 14

Using the same toner pulverizing material as in Example 1, it was pulverized by means of the pneumatic impact pulverizer shown in FIG. 8. The pneumatic impact pulverizer has the same construction as that used in Example 13.

The pulverizing material was fed to a forced vortex type air classifier by means of a constant-rate feeder at a rate of 31 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 6.1 $\mu$m was obtained as a classified fine powder. No melt-deposits occurred on the impact member of the pneumatic impact pulverizer to have enabled stable operation.

Example 15

Using the same toner pulverizing material as in Example 1, it was pulverized by means of the pneumatic impact pulverizer as shown in FIG. 8.

In the pneumatic impact pulverizer, the tip of the projected central area of the impact member, projected into the accelerating tube, is positioned at 10 mm from the accelerating tube outlet (L1=10 mm), the diameter of the space formed by the pulverization chamber upstream sidewall is 154 mm (B=154 mm), the diameter of the space formed by the pulverization chamber downstream sidewall is 136 mm (C=136 mm), and the distance between the outermost edge of the second impact face of the impact member and the innermost edge of the pulverization chamber impact wall is 35 mm (L6=35 mm). The projected central area 17 of the impact member 11 has a conical shape with a vertical angle of 65° ($\alpha$=65°) and the peripheral impact face 18 has a slope angle of 15° ($\beta$=15°) with respect to the axis of the accelerating tube 1. Therefore, ($\alpha$+2$\beta$) is 95°. Thus, the cross-sectional area of the inside of the pulverization chamber at its upstream side was larger than the cross-sectional area of the inside of the pulverization chamber corresponding to the outermost edge of the second impact face.

The pulverizing material was fed to a forced vortex type air classifier by means of a constant-rate feeder at a rate of 47 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 8.1 $\mu$m was obtained as a classified fine powder. No melt-deposits occurred on the impact member of the pneumatic impact pulverizer to have enabled stable operation, but, when the pulverizing material was fed in a quantity larger than 47 kg/h, the fine powder obtained came to have a larger weight average particle diameter.

Example 16

Using the same toner pulverizing material as in Example 1, it was pulverized by means of the pneumatic impact pulverizer shown in FIG. 8. The pneumatic impact pulverizer has the same construction as that used in Example 15.

The pulverizing material was fed to a forced vortex type air classifier by means of a constant-rate feeder at a rate of 31 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 6.1 $\mu$m was obtained as a classified fine powder. No melt-deposits occurred on the impact member of the pneumatic impact pulverizer to have enabled stable operation, but, when the pulverizing material was fed in a quantity larger than 31 kg/h, the fine powder obtained came to have a larger weight average particle diameter.

Example 17

Using the same toner pulverizing material as in Example 1, it was pulverized by means of the pneumatic impact pulverizer shown in FIG. 12.

In the pneumatic impact pulverizer, the tip of the projected central area of the impact member, projected into the accelerating tube, is positioned at 10 mm from the accelerating tube outlet (L1=10 mm), the diameter of the space formed by the pulverization chamber upstream sidewall 15 is 154 mm (B=154 mm), the diameter of the space formed by the pulverization chamber downstream sidewall 16 is 136 mm (C=136 mm), and the diameter of the front-zone pulverization chamber discharge outlet is 152 mm (F=152 mm). Thus, the cross-sectional area of the inside of the pulverization chamber at its upstream side was larger than the cross-sectional area of the inside of the pulverization chamber corresponding to the outermost edge of the second impact face. The projected central area 17 of the impact member 11 has a conical shape with a vertical angle of 55° ($\alpha$=55°) and the peripheral impact face 18 has a slope angle of 10° ($\beta$=10°) with respect to the axis of the accelerating tube 1. Therefore, ($\alpha$+2$\beta$) is 75°. The vertical angle of the impact member at its back portion is 80° ($\gamma$=80°).

The pulverizing material was fed to a forced vortex type air classifier by means of a constant-rate feeder at a rate of 50 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 8.0 $\mu$m was obtained as a classified fine powder. No melt-deposits occurred on the impact member of the pneumatic impact pulverizer to have enabled stable operation.

The classified product obtained was mixed with fine silica powder treated with amino-modified silicone oil in the same manner as in Example 1, to obtain a positively chargeable toner, and images were similarly formed using this toner. As a result, good images were obtained.

Example 18

Using the same toner pulverizing material as in Example 1, it was pulverized by means of the pneumatic impact pulverizer shown in FIG. 14.

In the pneumatic impact pulverizer, the tip of the projected central area of the impact member, projected into the accelerating tube, is positioned at 10 mm from the accelerating tube outlet (L1=10 mm), the diameter of the space formed by the pulverization chamber upstream sidewall 15 is 154 mm (B=154 mm), the diameter of the space formed by the pulverization chamber downstream sidewall 16 is 136 mm (C=136 mm), and the diameter of the front-zone pulverization chamber discharge outlet is 152 mm (F=152 mm). Thus, the cross-sectional area of the inside of the pulverization chamber at its upstream side was larger than the cross-sectional area of the inside of the pulverization chamber corresponding to the outermost edge of the second impact face. The projected central area 17 of the impact member 11 has a conical shape with a vertical angle of 55° ($\alpha$=55°) and the peripheral impact face 18 has a slope angle of 10° ($\beta$=10°) with respect to the axis of the accelerating tube 1. Therefore, ($\alpha$+2$\beta$) is 75°. The vertical angle of the impact member at its back portion is 80° ($\gamma$=80°).

The pulverizing material was fed to a forced vortex type air classifier by means of a constant-rate feeder at a rate of 49 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 8.1 $\mu$m was obtained as a classified fine powder. No melt-deposits occurred on the impact member of the pneumatic impact pulverizer to have enabled stable operation.

Example 19

Using the same toner pulverizing material as in Example 1, it was pulverized by means of the pneumatic impact pulverizer shown in FIG. 12. The pneumatic impact pulverizer has the same construction as that used in Example 17.

The pulverizing material was fed to a forced vortex type air classifier by means of a constant-rate feeder at a rate of 33 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 6.0 $\mu$m was obtained as a classified fine powder. No melt-deposits occurred on the impact member of the pneumatic impact pulverizer to have enabled stable operation.

Example 20

Using the same toner pulverizing material as in Example 1, it was pulverized by means of the pneumatic impact pulverizer shown in FIG. 14. The pneumatic impact pulverizer has the same construction as that used in Example 18.

The pulverizing material was fed to a forced vortex type air classifier by means of a constant-rate feeder at a rate of 33 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 6.1 $\mu$m was obtained as a classified fine powder. No melt-deposits occurred on the impact member of the pneumatic impact pulverizer to have enabled stable operation.

Example 21

Using the same toner pulverizing material as in Example 1, it was pulverized by means of the pneumatic impact pulverizer as shown in FIG. 12.

In the pneumatic impact pulverizer, the projected central area of the impact member is not projected into the accelerating tube and its tip is positioned at −5 mm from the accelerating tube outlet (L1=−5 mm), the diameter of the space formed by the pulverization chamber upstream sidewall is 154 mm (B=154 mm), and the diameter of the space formed by the pulverization chamber downstream sidewall is 136 mm (C=136 mm). Thus, the cross-sectional area of the inside of the pulverization chamber at its upstream side was larger than the cross-sectional area of the inside of the pulverization chamber corresponding to the outermost edge of the second impact face. The projected central area 17 of the impact member 11 has a conical shape with a vertical angle of 55° ($\alpha$=55°) and the peripheral impact face 18 has a slope angle of 10° ($\beta$=10°) with respect to the axis of the accelerating tube 1. Therefore, ($\alpha$+2$\beta$) is 75°.

The pulverizing material was fed to a forced vortex type air classifier by means of a constant-rate feeder at a rate of 48 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 8.1 $\mu$m was obtained as a classified fine powder. No melt-deposits occurred on the impact member of the pneumatic impact pulverizer to have enabled stable operation.

Example 22

Using the same toner pulverizing material as in Example 1, it was pulverized by means of the pneumatic impact pulverizer shown in FIG. 12. The pneumatic impact pulverizer has the same construction as that used in Example 21.

The pulverizing material was fed to a forced vortex type air classifier by means of a constant-rate feeder at a rate of 31 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 6.1 $\mu$m was obtained as a classified fine powder. No melt-deposits occurred on the impact member of the pneumatic impact pulverizer to have enabled stable operation.

Example 23

Using the same toner pulverizing material as in Example 1, it was pulverized by means of the pneumatic impact pulverizer as shown in FIG. 12.

In the pneumatic impact pulverizer, the tip of the projected central area of the impact member, projected into the accelerating tube, is positioned at 10 mm from the accelerating tube outlet (L1=10 mm), the diameter of the space formed by the pulverization chamber upstream sidewall is 154 mm (B=154 mm), and the diameter of the space formed by the pulverization chamber downstream sidewall is 136 mm (C=136 mm). Thus, the cross-sectional area of the inside of the pulverization chamber at its upstream side was larger than the cross-sectional area of the inside of the pulverization chamber corresponding to the outermost edge of the second impact face. The projected central area 17 of the impact member 11 has a conical shape with a vertical angle of 65° ($\alpha$=65°) and the peripheral impact face 18 has a slope angle of 15° ($\beta$=15°) with respect to the axis of the accelerating tube 1. Therefore, ($\alpha+2\beta$) is 95°.

The pulverizing material was fed to a forced vortex type air classifier by means of a constant-rate feeder at a rate of 47 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 8.1 $\mu$m was obtained as a classified fine powder. No melt-deposits occurred on the impact member of the pneumatic impact pulverizer to have enabled stable operation, but, when the pulverizing material was fed in a quantity larger than 47 kg/h, the fine powder obtained came to have a larger weight average particle diameter.

Example 24

Using the same toner pulverizing material as in Example 1, it was pulverized by means of the pneumatic impact pulverizer shown in FIG. 12. The pneumatic impact pulverizer has the same construction as that used in Example 23.

The pulverizing material was fed to a forced vortex type air classifier by means of a constant-rate feeder at a rate of 31 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 6.1 $\mu$m was obtained as a classified fine powder. No melt-deposits occurred on the impact member of the pneumatic impact pulverizer to have enabled stable operation, but, when the pulverizing material was fed in a quantity larger than 31 kg/h, the fine powder obtained came to have a larger weight average particle diameter.

Comparative Example 1

Figure 21:
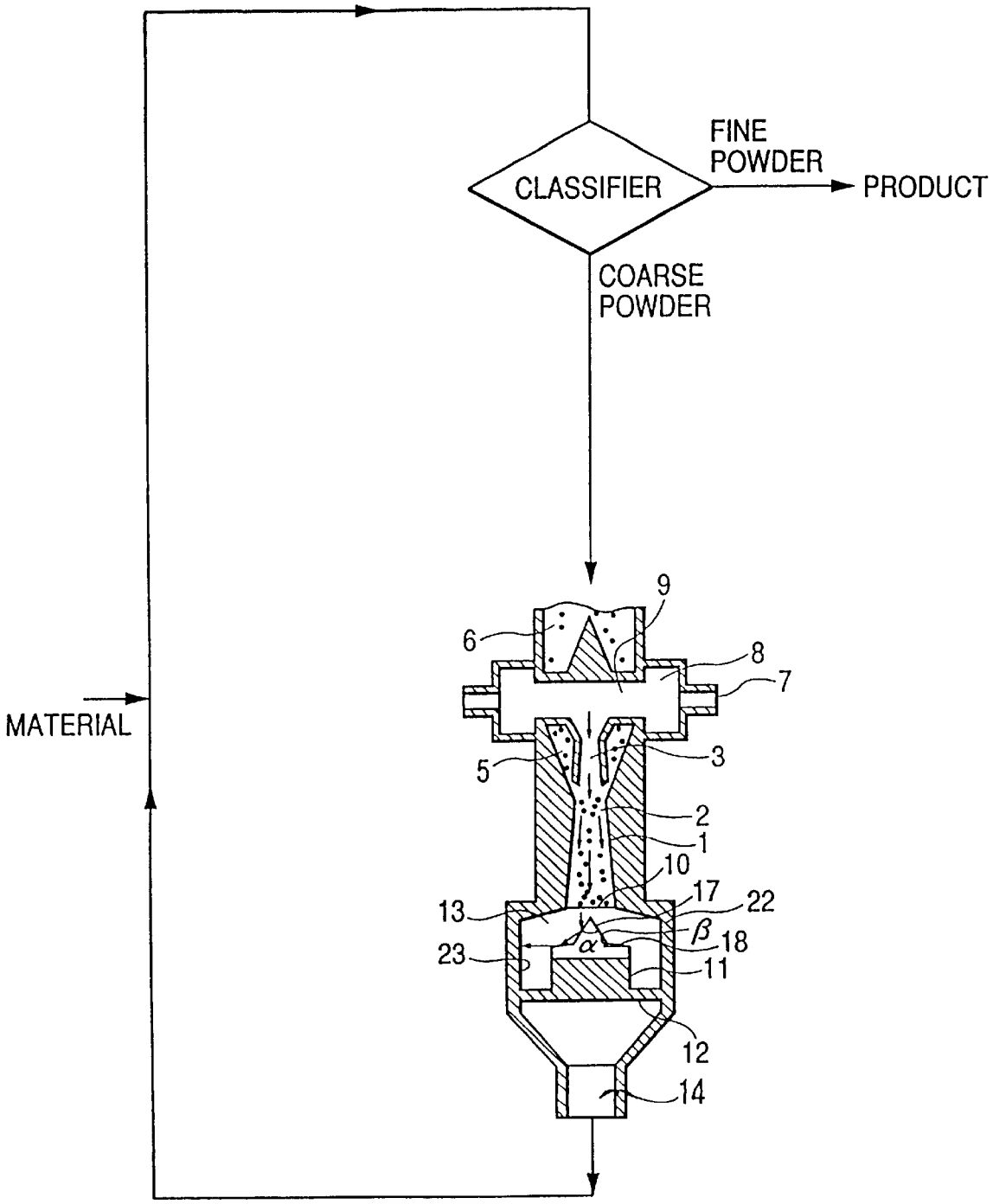
FIG. 21 PRIOR ART
FIG. 21 is a schematic cross section illustrating still another conventional pneumatic impact pulverizer.

Using the same toner pulverizing material as in Example 1, it was pulverized by means of the pneumatic impact pulverizer as shown in FIG. 21.

In the pneumatic impact pulverizer, the projected central area of the impact member is not projected into the accelerating tube and its tip is positioned at −5 mm from the accelerating tube outlet (L1=−5 mm), the diameter of the space formed by the pulverization chamber upstream sidewall is 140 mm (B=140 mm), the diameter of the space formed by the pulverization chamber downstream sidewall is 140 mm (C=140 mm), and the diameter of the front-zone pulverization chamber discharge outlet is 140 mm (F=140 mm). The projected central area 17 of the impact member 11 has a conical shape with a vertical angle of 55° ($\alpha$=55°) and the peripheral impact face 18 has a slope angle of 10° ($\beta$=10°) with respect to the axis of the accelerating tube 1. Therefore, ($\alpha+2\beta$) is 75°. The vertical angle of the impact member at its back portion is 108° ($\gamma$=180°).

The pulverizing material was fed to a forced vortex type air classifier by means of a constant-rate feeder at a rate of 46 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 8.1 $\mu$m was obtained as a classified fine powder. No melt-deposits occurred on the impact member of the pneumatic impact pulverizer to have enabled stable operation, but, when the pulverizing material was fed in a quantity larger than 46 kg/h, the fine powder obtained came to have a larger weight average particle diameter.

Comparative Example 2

Figure 16:
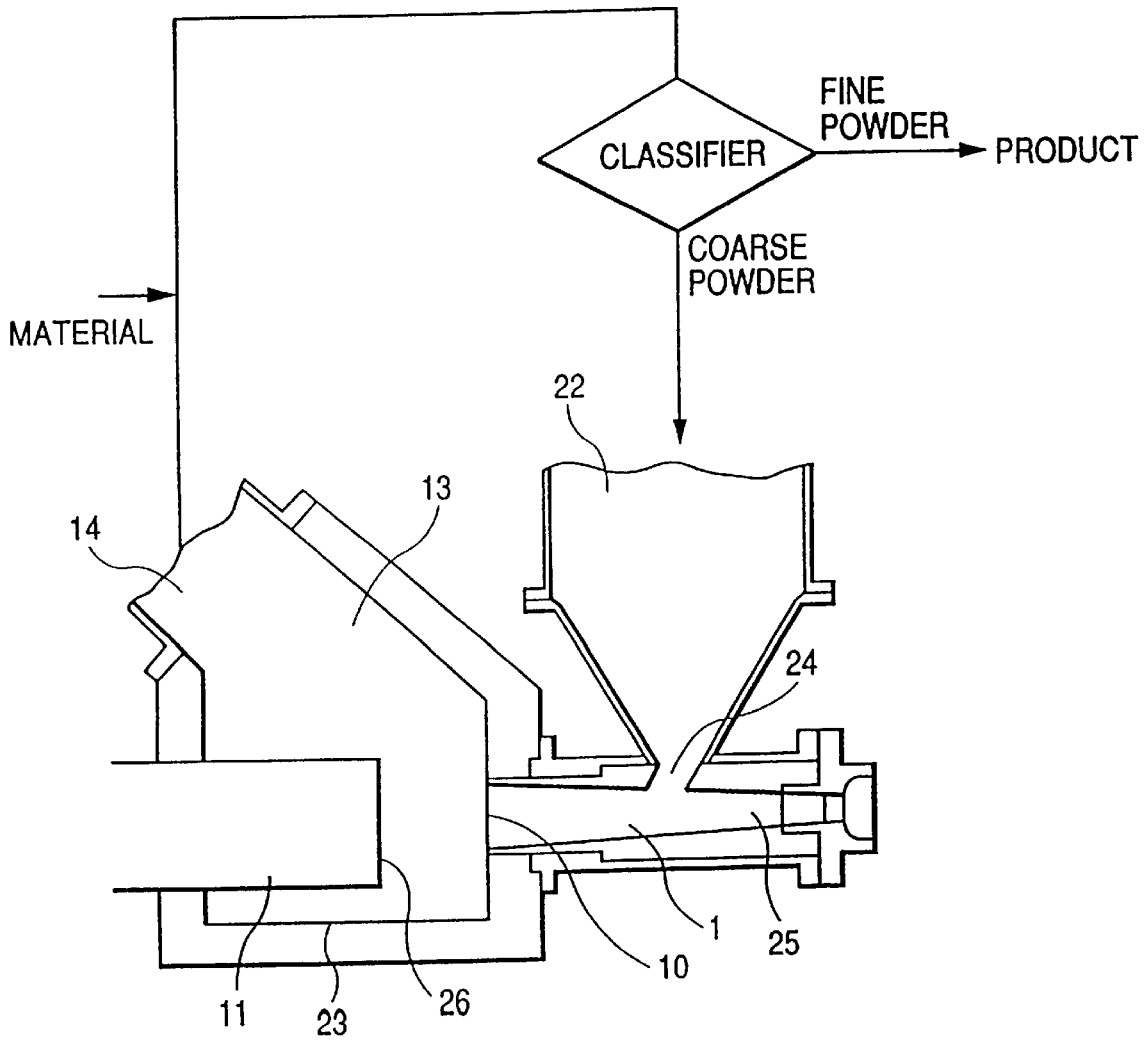
FIG. 16 PRIOR ART
FIG. 16 is a schematic cross section illustrating a conventional pneumatic impact pulverizer.
Figure 17:
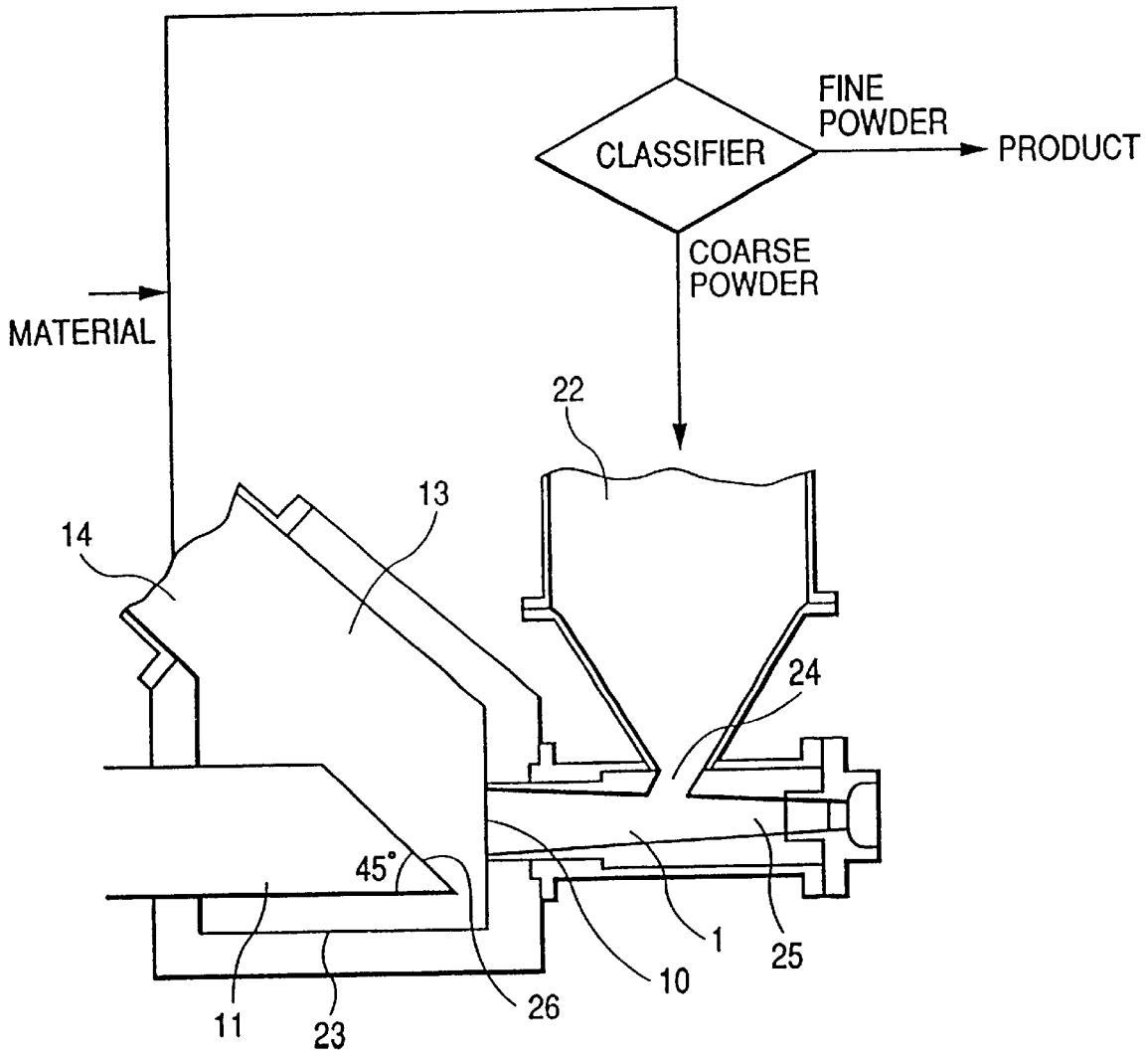
FIG. 17 PRIOR ART
FIG. 17 is a schematic cross section illustrating another conventional pneumatic impact pulverizer.
Figure 18:
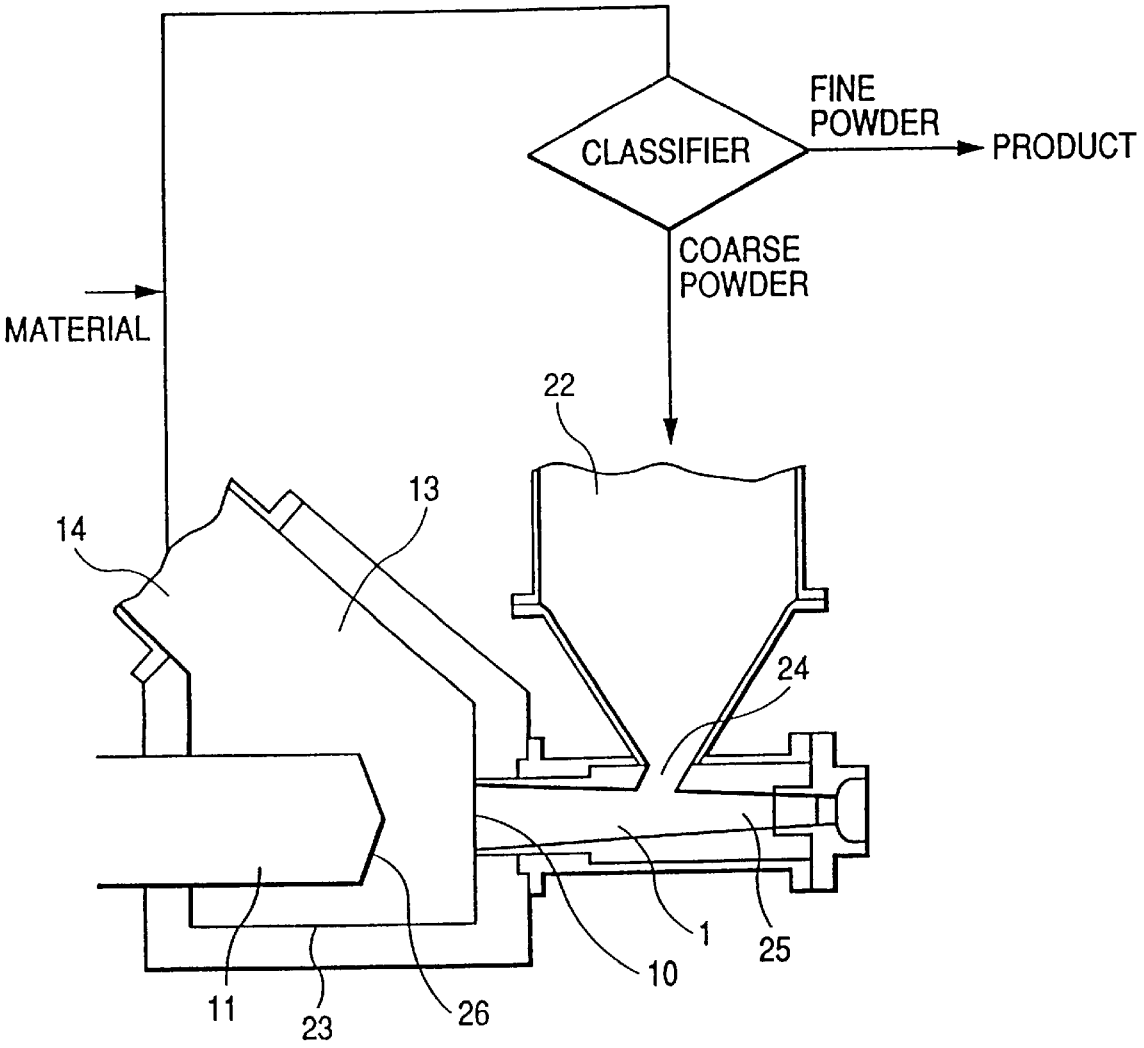
FIG. 18 PRIOR ART
FIG. 18 is a schematic cross section illustrating still another conventional pneumatic impact pulverizer.

Using the same toner pulverizing material as in Example 1, it was pulverized by means of the pneumatic impact pulverizer shown in FIG. 16.

In the pneumatic impact pulverizer used, the impact face has a flat shape which is vertical to the axial direction of the accelerating tube, and the pulverization chamber has a boxy shape.

The pulverizing material was fed to a forced vortex type air classifier by means of a constant-rate feeder at a rate of 18 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 8.3 $\mu$m was obtained as a classified fine powder. When the pulverizing material was fed in a quantity larger than 18 kg/h, the fine powder obtained came to have a larger weight average particle diameter and also melt-deposits and agglomerates on the impact member and coarse particles began to occur, where the melt-deposits sometimes clogged the material feed inlet of the accelerating tube, not to have enabled stable operation.

Comparative Example 3

Figure 19:
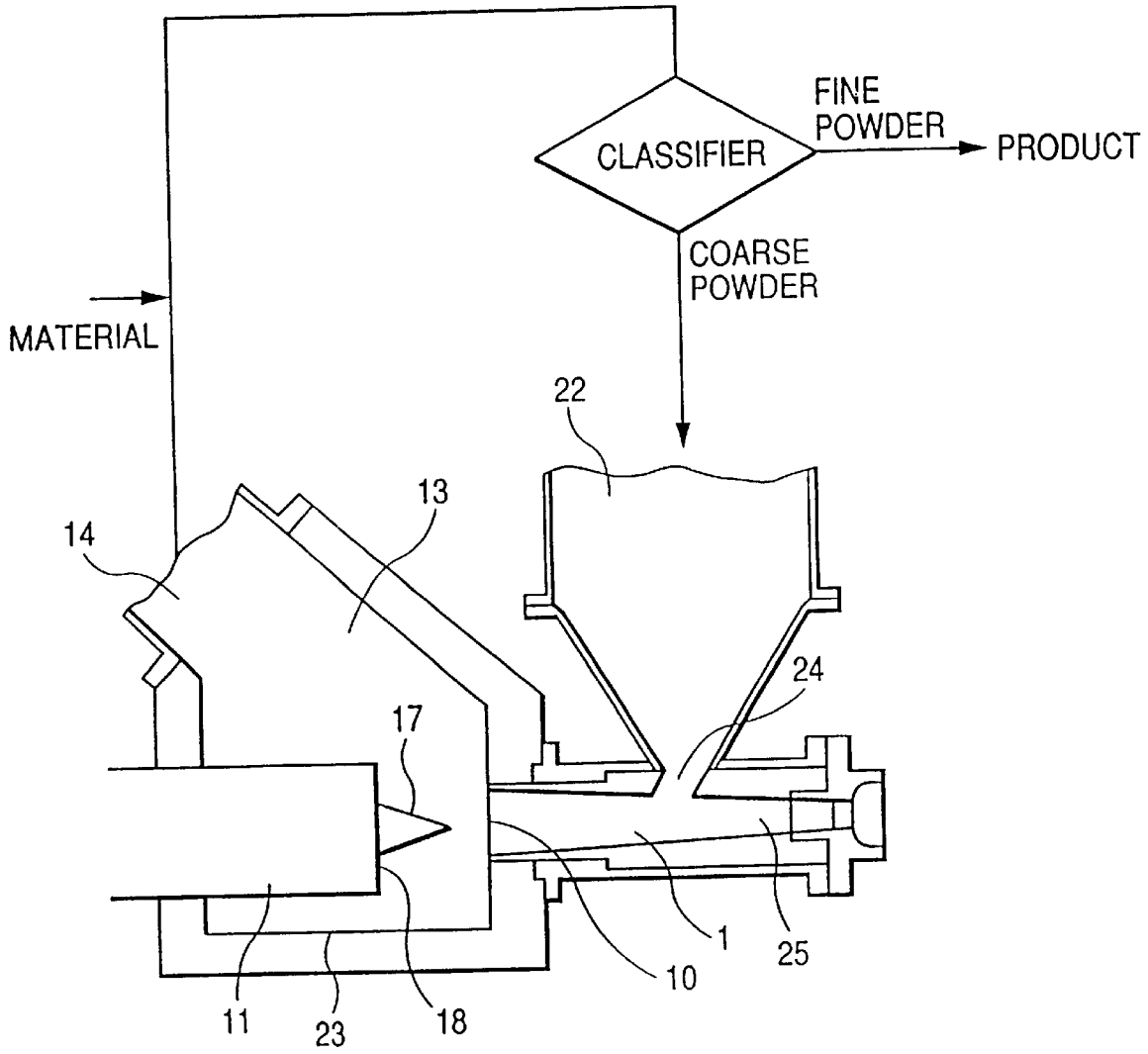
FIG. 19 PRIOR ART
FIG. 19 is a schematic cross section illustrating still another conventional pneumatic impact pulverizer.
Figure 20:
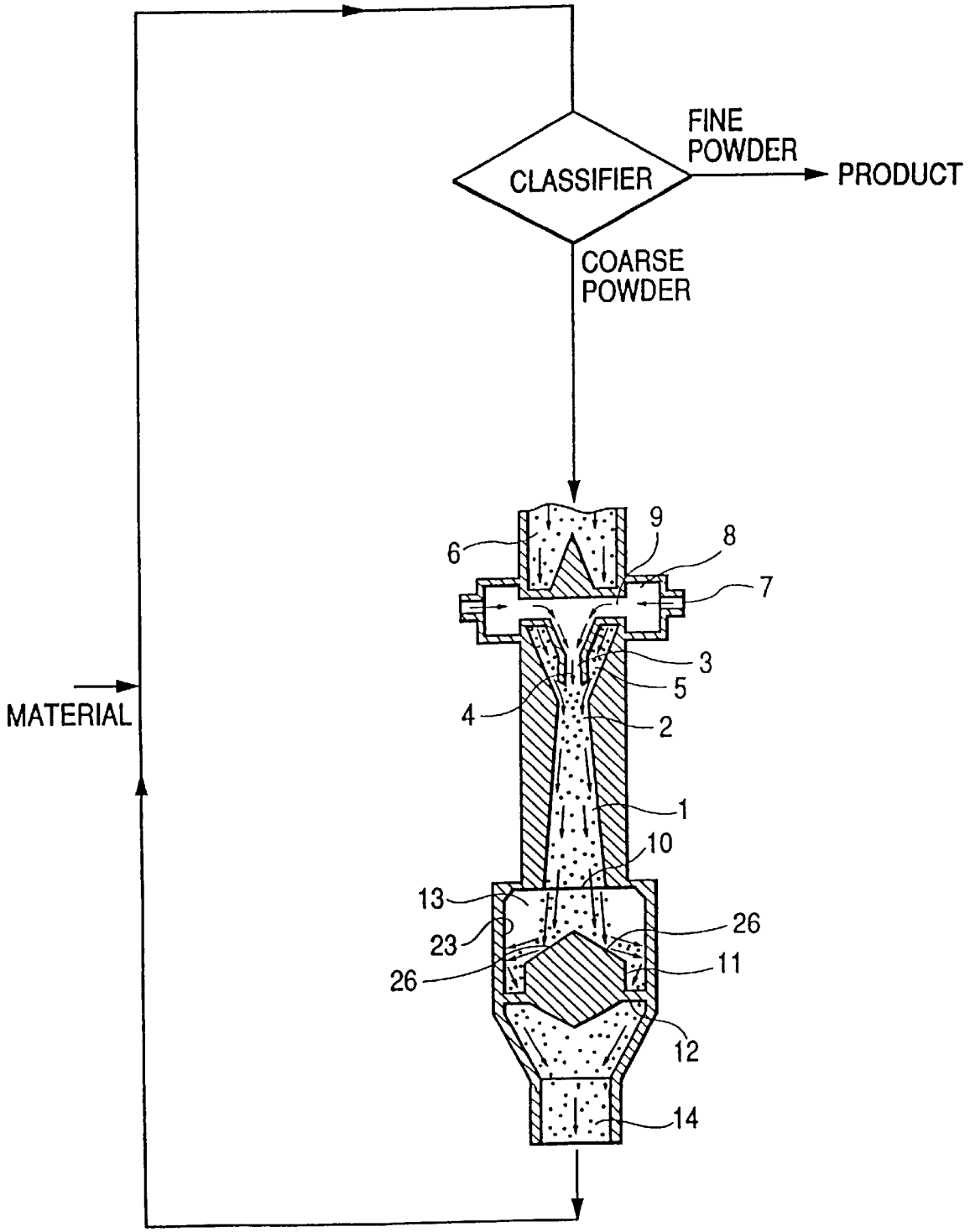
FIG. 20 PRIOR ART
FIG. 20 is a schematic cross section illustrating still another conventional pneumatic impact pulverizer.

Using the same toner pulverizing material as in Example 1, it was pulverized by means of the pneumatic impact pulverizer as shown in FIG. 19.

In the pneumatic impact pulverizer, the projected central area 17 of the impact member 11 has a conical shape with a vertical angle of 55° ($\alpha$=55°) and the peripheral impact face 18 has a slope angle of 10° ($\beta$=10°) with respect to the axis of the accelerating tube 1. Therefore, ($\alpha+2\beta$) is 75°. The pulverization chamber has a boxy shape.

The pulverizing material was fed to a forced vortex type air classifier by means of a constant-rate feeder at a rate of 22 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 8.1 μm was obtained as a classified fine powder. When the pulverizing material was fed in a quantity larger than 22 kg/h, the fine powder obtained came to have a larger weight average particle diameter. No melt-deposits were seen to occur on the impact member of the pneumatic impact pulverizer.

Comparative Example 4

Using the same toner pulverizing material as in Example 1, it was pulverized by means of the pneumatic impact pulverizer shown in FIG. 21. The pneumatic impact pulverizer has the same construction as that used in Comparative Example 1.

The pulverizing material was fed to a forced vortex type air classifier by means of a constant-rate feeder at a rate of 30 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 6.1 μm was obtained as a classified fine powder. When the pulverizing material was fed in a quantity larger than 30 kg/h, the fine powder obtained came to have a larger weight average particle diameter. No melt-deposits occurred on the impact member of the pneumatic impact pulverizer to have enabled stable operation.

Comparative Example 5

Using the same toner pulverizing material as in Example 1, it was pulverized by means of the pneumatic impact pulverizer shown in FIG. 16. The pneumatic impact pulverizer has the same construction as that used in Comparative Example 2.

The pulverizing material was fed to a forced vortex type air classifier by means of a constant-rate feeder at a rate of 8 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 6.4 μm was obtained as a classified fine powder. When the pulverizing material was fed in a quantity larger than 8 kg/h, the fine powder obtained came to have a larger weight average particle diameter and also, when the pulverizing material was fed in a quantity larger than 18 kg/h, melt-deposits and agglomerates on the impact member and coarse particles began to occur, where the melt-deposits sometimes clogged the material feed inlet of the accelerating tube, not to have enabled stable operation.

Comparative Example 6

Using the same toner pulverizing material as in Example 1, it was pulverized by means of the pneumatic impact pulverizer shown in FIG. 19. The pneumatic impact pulverizer has the same construction as that used in Comparative Example 3.

The pulverizing material was fed to a forced vortex type air classifier by means of a constant-rate feeder at a rate of 14 kg/h, and the coarse powder thus classified was introduced into the pneumatic impact pulverizer to carry out pulverization using compressed air of 6.0 kg/cm$^2$ (G) pressure and 6.0 m$^3$/min flow rate. Thereafter, the pulverized product obtained was again circulated to the classifier to carry out closed-circuit grinding. As the result, a finely ground product for toner (a classified product) with a weight average particle diameter of 6.2 μm was obtained as a classified fine powder. When the pulverizing material was fed in a quantity larger than 14 kg/h, the fine powder obtained came to have a larger weight average particle diameter. No melt-deposits were seen to occur on the impact member of the pneumatic impact pulverizer.

Results obtained in the foregoing Examples 1 to 24 and Comparative Example 1 to 6 are shown together in Tables 1(A) and 1(B).

In Table 1(B), the pulverization efficiency ratio is indicated as the ratio of feed quantity in each instance to feed quantity in Comparative Example 3.

In Table 1(B);

(1): Weight average particle diameter
(2): Pulverization efficiency ratio
(3): Apparatus stability
"A": No melt-deposits occur even when the quantity of the pulverizing powder material fed is larger than 20 kg/h.
"B": No melt-deposits occur when the quantity of the pulverizing powder material fed is up to 20 kg/h.
"C": Melt-deposits occur even when the quantity of the pulverizing powder material fed is smaller than 20 kg/h.

TABLE 1(A)

| Pulverizer | | A (mm) | B (mm) | C (mm) | D (mm) | E (mm) | F (mm) | L1 (mm) | L2 (mm) | L3 (mm) | L4 (mm) | L5 (mm) | L6 (mm) |
|---|---|---|---|---|---|---|---|---|---|---|---|---|---|
| Example: | | | | | | | | | | | | | |
| 1 | FIG. 1 | 100 | 154 | 136 | 38 | — | — | +10 | 53 | 4 | 47 | 35 | — |
| 2 | FIG. 6 | 100 | 154 | 136 | 38 | — | — | +10 | 53 | 4 | 47 | 35 | — |
| 3 | FIG. 1 | 100 | 154 | 136 | 38 | — | — | +10 | 53 | 4 | 47 | 35 | — |
| 4 | FIG. 6 | 100 | 154 | 136 | 38 | — | — | +10 | 53 | 4 | 47 | 35 | — |
| 5 | FIG. 1 | 100 | 154 | 136 | 38 | — | — | −5 | 53 | 4 | 52 | 50 | — |
| 6 | FIG. 1 | 100 | 154 | 136 | 38 | — | — | −5 | 53 | 4 | 52 | 50 | — |
| 7 | FIG. 1 | 100 | 154 | 136 | 38 | — | — | +10 | 53 | 4 | 47 | 35 | — |
| 8 | FIG. 1 | 100 | 154 | 136 | 38 | — | — | +10 | 53 | 4 | 47 | 35 | — |
| 9 | FIG. 8 | 100 | 154 | 136 | 38 | 132 | — | +10 | 53 | 4 | 47 | — | 35 |
| 10 | FIG. 10 | 100 | 154 | 136 | 38 | 132 | — | +10 | 53 | 4 | 47 | — | 35 |
| 11 | FIG. 8 | 100 | 154 | 136 | 38 | 132 | — | +10 | 53 | 4 | 47 | — | 35 |

TABLE 1(A)-continued

| Pulverizer | | A (mm) | B (mm) | C (mm) | D (mm) | E (mm) | F (mm) | L1 (mm) | L2 (mm) | L3 (mm) | L4 (mm) | L5 (mm) | L6 (mm) |
|---|---|---|---|---|---|---|---|---|---|---|---|---|---|
| 12 | FIG. 10 | 100 | 154 | 136 | 38 | 132 | — | +10 | 53 | 4 | 47 | — | 35 |
| 13 | FIG. 8 | 100 | 154 | 136 | 38 | 132 | — | −5 | 53 | 4 | 52 | — | 35 |
| 14 | FIG. 8 | 100 | 154 | 136 | 38 | 132 | — | −5 | 53 | 4 | 52 | — | 35 |
| 15 | FIG. 8 | 100 | 154 | 136 | 38 | 132 | — | +10 | 53 | 4 | 47 | — | 35 |
| 16 | FIG. 8 | 100 | 154 | 136 | 38 | 132 | — | +10 | 53 | 4 | 47 | — | 35 |
| 17 | FIG. 12 | 100 | 154 | 136 | 38 | — | 152 | +10 | 53 | 4 | 47 | 35 | — |
| 18 | FIG. 14 | 100 | 154 | 136 | 38 | — | 152 | +10 | 53 | 4 | 47 | 35 | — |
| 19 | FIG. 12 | 100 | 154 | 136 | 38 | — | 152 | +10 | 53 | 4 | 47 | 35 | — |
| 20 | FIG. 14 | 100 | 154 | 136 | 38 | — | 152 | +10 | 53 | 4 | 47 | 35 | — |
| 21 | FIG. 12 | 100 | 154 | 136 | 38 | — | 152 | −5 | 53 | 4 | 52 | 50 | — |
| 22 | FIG. 12 | 100 | 154 | 136 | 38 | — | 152 | −5 | 53 | 4 | 52 | 50 | — |
| 23 | FIG. 12 | 100 | 154 | 136 | 38 | — | 152 | +10 | 53 | 4 | 47 | 35 | — |
| 24 | FIG. 12 | 100 | 154 | 136 | 38 | — | 152 | +10 | 53 | 4 | 47 | 35 | — |
| Comparative Example: | | | | | | | | | | | | | |
| 1 | FIG. 21 | 100 | 140 | 140 | 34 | — | — | −5 | 53 | 4 | 67 | — | — |
| 2 | FIG. 16 | — | — | — | — | — | — | — | — | — | — | — | — |
| 3 | FIG. 19 | 60 | — | — | — | — | — | — | — | — | — | — | — |
| 4 | FIG. 21 | 100 | 140 | 140 | 34 | — | — | −5 | 53 | 4 | 67 | — | — |
| 5 | FIG. 16 | — | — | — | — | — | — | — | — | — | — | — | — |
| 6 | FIG. 19 | 60 | — | — | — | — | — | — | — | — | — | — | — |

TABLE 1(B)

| | α (°) | β (°) | θ (°) | γ (°) | Impact face shape | Feed rate (kg/h) | (1) (μm) | (2) | (3) |
|---|---|---|---|---|---|---|---|---|---|
| Example: | | | | | | | | | |
| 1 | 55 | 10 | — | — | Conical projection | 54 | 8.0 | 2.46 | A |
| 2 | 55 | 10 | — | — | Conical projection | 53 | 8.1 | 2.41 | A |
| 3 | 55 | 10 | — | — | Conical projection | 36 | 6.0 | 1.64 | A |
| 4 | 55 | 10 | — | — | Conical projection | 35 | 6.1 | 1.59 | A |
| 5 | 55 | 10 | — | — | Conical projection | 52 | 8.1 | 2.36 | A |
| 6 | 55 | 10 | — | — | Conical projection | 34 | 6.1 | 1.55 | A |
| 7 | 65 | 15 | — | — | Conical projection | 51 | 8.1 | 2.32 | A |
| 8 | 65 | 15 | — | — | Conical projection | 33 | 6.1 | 1.50 | A |
| 9 | 55 | 10 | 8 | — | Conical projection | 52 | 8.0 | 2.36 | A |
| 10 | 55 | 10 | 8 | — | Conical projection | 51 | 8.1 | 2.31 | A |
| 11 | 55 | 10 | 8 | — | Conical projection | 34 | 6.0 | 1.55 | A |
| 12 | 55 | 10 | 8 | — | Conical projection | 33 | 6.1 | 1.50 | A |
| 13 | 55 | 10 | 8 | — | Conical projection | 48 | 8.1 | 2.18 | A |
| 14 | 55 | 10 | 8 | — | Conical projection | 31 | 6.1 | 1.41 | A |
| 15 | 65 | 15 | 50 | — | Conical projection | 47 | 8.1 | 2.14 | A |
| 16 | 65 | 15 | 50 | — | Conical projection | 47 | 8.1 | 2.14 | A |
| 17 | 55 | 10 | — | 80 | Conical projection | 50 | 8.0 | 2.27 | A |
| 18 | 55 | 10 | — | 80 | Conical projection | 49 | 8.1 | 2.23 | A |
| 19 | 55 | 10 | — | 80 | Conical projection | 33 | 6.0 | 1.50 | A |
| 20 | 55 | 10 | — | 80 | Conical projection | 33 | 6.1 | 1.45 | A |
| 21 | 55 | 10 | — | 80 | Conical projection | 48 | 8.1 | 2.18 | A |
| 22 | 55 | 10 | — | 80 | Conical projection | 31 | 6.1 | 1.41 | A |
| 23 | 65 | 15 | — | — | Conical projection | 31 | 6.1 | 1.41 | A |
| 24 | 65 | 15 | — | 180 | Conical projection | 31 | 6.1 | 1.41 | A |
| Comparative Example: | | | | | | | | | |
| 1 | 55 | 10 | — | 180 | Conical projection | 46 | 8.1 | 2.09 | A |
| 2 | — | — | — | — | Flat face | 18 | 8.3 | 0.82 | C |
| 3 | — | — | — | — | Conical projection | 22 | 8.1 | 1.00 | B |
| 4 | 55 | 10 | — | — | Conical projection | 30 | 6.1 | 1.36 | A |
| 5 | — | — | — | — | Flat face | 8 | 6.4 | 0.36 | C |
| 6 | — | — | — | — | Conical projection | 14 | 6.2 | 0.63 | B |

What is claimed is:

1. A pneumatic impact pulverizer comprising:

a high-pressure gas feed nozzle for feeding a high-pressure gas;

a single accelerating tube for transporting and accelerating a pulverizing material in said accelerating tube by the aid of the high-pressure gas fed through said high-pressure gas feed nozzle;

a pulverization chamber for pulverizing the pulverizing material ejected out of an accelerating tube outlet; and an impact member for pulverizing the pulverizing material ejected out of said accelerating tube outlet, provided at a position opposite to said accelerating tube outlet in said pulverization chamber, wherein said impact member has at least a first impact face projecting toward said accelerating tube side at a vertical angle $\alpha$ around the axis of said accelerating tube and a second impact face sloped toward a downstream side at an angle $\beta$ with respect to a perpendicular line formed toward the axis of said accelerating tube;

said pulverization chamber has at least a first sidewall positioned on the side more upstream than an outermost edge of said second impact face and a second sidewall positioned on the downstream side of said first sidewall and extending toward the downstream side; and said pulverization chamber is enlarged at its part on the side more upstream than said outermost edge of said second impact face so as to have a zone where the cross-sectional area of the inside of said pulverization chamber is larger than the cross-sectional area of the inside of said pulverization chamber corresponding to said outermost edge of said second impact face, and a tip of said first impact face is positioned on the side more upstream than the downstream side edge of said first sidewall; and the distance between the outermost edge of said second impact face and said accelerating tube outlet is L4, and the distance between said accelerating tube outlet and said second sidewall is L5, with $L5 \leqq L4$.

2. The pneumatic impact pulverizer according to claim 1, wherein said vertical angle $\alpha$ and said slope angle $\beta$ satisfy the following relationship:

$0<\alpha<90,\ \beta>0$ $30 \leqq (\alpha+2\beta) \leqq 90$.

3. The pneumatic impact pulverizer according to claim 1, wherein said vertical angle $\alpha$ and said slope angle $\beta$ satisfy the following relationship:

$0<\alpha<90,\ \beta>0$ $50 \leqq (\alpha+2\beta) \leqq 90$.

4. The pneumatic impact pulverizer according to claim 1, wherein, when the diameter across said outermost edge of said second impact face is represented by width A, the maximum diameter of the space formed by the upstream sidewall of said pulverization chamber standing opposite to said impact member by width B, and the minimum diameter of the space formed by said second sidewall by width C, the A, B and C satisfy the following relationship:

$C<B \leqq 1.6\times C$ $A<C<1.6\times A$.

5. The pneumatic impact pulverizer according to claim 1, wherein, when the diameter across said outermost edge of said second impact face is represented by width A, the maximum diameter of the space formed by the upstream sidewall of said pulverization chamber standing opposite to said impact member by width B, and the minimum diameter of the space formed by said second sidewall by width C, the A, B and C satisfy the following relationship:

$C<B \leqq 1.2\times C$ $A<C<1.5\times A$.

6. The pneumatic impact pulverizer according to claim 1, wherein;

when the diameter across said outermost edge of said second impact face is represented by width A, the maximum diameter of the space formed by the upstream sidewall of said pulverization chamber standing opposite to said impact member by width B, and the minimum diameter of the space formed by said second sidewall by width C, the A, B and C satisfy the following relationship:

$C<B \leqq 1.6\times C$ $A<C<1.6\times A$; and when the diameter of said accelerating tube outlet is represented by D, the distance between said accelerating tube outlet and the top of said first impact face by L1, the height of said first impact face by L2, the height of said second impact face by L3, the distance between the outermost edge of said second impact face and said accelerating tube outlet by L4, and the distance between said accelerating tube outlet and said second sidewall by L5, the L1, L2, L3, L4 and L5 satisfy the following relationship:

$|L1| \leqq D/\{2\times\tan(\alpha/2)\}$ $L5 \leqq L4 \leqq L2+L3$.

7. The pneumatic impact pulverizer according to claim 1, wherein;

when the diameter across said outermost edge of said second impact face is represented by width A, the maximum diameter of the space formed by the upstream sidewall of said pulverization chamber standing opposite to said impact member by width B, and the minimum diameter of the space formed by said second sidewall by width C, the A, B and C satisfy the following relationship:

$C<B \leqq 1.6\times C$ $A<C<1.6\times A$; and when the diameter of said accelerating tube outlet is represented by D, the distance between said accelerating tube outlet and the top of said first impact face by L1, the height of said first impact face by L2, the height of said second impact face by L3, the distance between the outermost edge of said second impact face and said accelerating tube outlet by L4, and the distance between said accelerating tube outlet and said second sidewall by L5, the L1, L2, L3, L4 and L5 satisfy the following relationship:

$0<L1 \leqq D/\{2\times\tan(\alpha/2)\}$ $L5 \leqq L4 \leqq L2+L3$.

8. The pneumatic impact pulverizer according to claim 1, wherein;

said impact member has a conical shape with a vertical angle $\gamma$ at its side opposite to the side on which said first impact face and second impact face are provided;

when the diameter across the outermost edge of said second impact face is represented by width A, the maximum diameter of the space formed by the upstream sidewall of said pulverization chamber standing opposite to said impact member by width B, and the minimum diameter of the space formed by said second sidewall by width C, the A, B and C satisfy the following relationship:

$C<B \leqq 1.6\times C$ $A<C<1.6\times A$;

when the diameter of said accelerating tube outlet is represented by D, the distance between said accelerating tube outlet and the top of said first impact face by L1, the height of said first impact face by L2, the height of said second impact face by L3, the distance between said outermost edge of said second impact face and said accelerating tube outlet by L4, and the distance between said accelerating tube outlet and said second sidewall by L5, the L1, L2, L3, L4 and L5 satisfy the following relationship:

$|L1| \leqq D/\{2\times\tan(\alpha/2)\}$ $L5 \leqq L4 \leqq L2+L3$;

when the diameter of the most enlarged part in the zone extending from the lowermost part of said second sidewall of said pulverization chamber to the pulverized product discharge outlet is represented by F, the F and C satisfy the following relationship:

$F>C$; and the vertical angle $\gamma$ of said impact member satisfies the following relationship:

$0<\gamma<90$.

9. The pneumatic impact pulverizer according to claim 1, wherein;

said impact member has a conical shape with a vertical angle $\gamma$ at its side opposite to the side on which said first impact face and second impact face are provided;

when the diameter across the outermost edge of said second impact face is represented by width A, the maximum diameter of the space formed by the upstream sidewall of said pulverization chamber standing opposite to said impact member by width B, and the minimum diameter of the space formed by said second sidewall by width C, the A, B and C satisfy the following relationship:

$C<B \leqq 1.6\times C$ $A<C<1.6\times A$;

when the diameter of said accelerating tube outlet is represented by D, the distance between said accelerating tube outlet and the top of said first impact face by L1, the height of said first impact face by L2, the height of said second impact face by L3, the distance between the outermost edge of said second impact face and said accelerating tube outlet by L4, and the distance between said accelerating tube outlet and said second sidewall by L5, the L1, L2, L3, L4 and L5 satisfy the following relationship:

$0<L1 \leqq D/\{2\times\tan(\alpha/2)\}$ $L5 \leqq L4 \leqq L2+L3$;

when the diameter of the most enlarged part in the zone extending from the lowermost part of said second sidewall of said pulverization chamber to the pulverized product discharge outlet is represented by F, the F and C satisfy the following relationship:

$F>C$; and the vertical angle $\gamma$ of said impact member satisfies the following relationship:

$0<\gamma<90$.

10. The pneumatic impact pulverizer according to claim 1, wherein said accelerating tube is provided at an inclination of from 0 to 45° in the axial direction of said accelerating tube on the basis of its vertical line.

11. The pneumatic impact pulverizer according to claim 1, wherein said accelerating tube is provided at an inclination of from 0 to 20° in the axial direction of said accelerating tube on the basis of its vertical line.

12. The pneumatic impact pulverizer according to claim 1, wherein said accelerating tube is provided at an inclination of from 0 to 5° in the axial direction of said accelerating tube on the basis of its vertical line.

13. The pneumatic impact pulverizer according to claim 1, wherein said pulverization chamber has a pulverized product discharge outlet for discharging the pulverized product from said pulverization chamber, provided on the side more downstream than said impact member and in the direction opposite to the side on which said impact faces of said impact member are provided.

14. The pneumatic impact pulverizer according to claim 1, wherein said accelerating tube has a pulverizing material feed opening for feeding the pulverizing material into said accelerating tube through the circumference of the accelerating tube.

15. A process for producing a toner, comprising the steps of:

melt-kneading a mixture containing at least a binder resin and a colorant, to obtain a kneaded product;

cooling the resultant kneaded product to obtain a solidified product;

crushing the resultant solidified product to obtain a crushed product;

pulverizing the resultant crushed product in a pneumatic impact pulverizer; and providing a pneumatic impact pulverizer to pulverize the crushed product, with the pulverizer including:

a high-pressure gas feed nozzle for feeding a high-pressure gas;

a single accelerating tube for transporting and accelerating a pulverizing material in the accelerating tube by the aid of the high-pressure gas fed through the high-pressure gas feed nozzle;

a pulverization chamber for pulverizing the pulverizing material ejected out of an accelerating tube outlet; and an impact member for pulverizing the pulverizing material ejected out of the accelerating tube outlet, provided at a position opposite to the accelerating tube outlet in the pulverization chamber, wherein the impact member has at least a first impact face projecting toward the accelerating tube side at a vertical angle $\alpha$ around the axis of the accelerating tube and a second impact face sloped toward the downstream side at an angle $\beta$ with respect to a perpendicular line formed toward the axis of the accelerating tube;

the pulverization chamber has at least a first sidewall positioned on the side more upstream than the outermost edge of the second impact face and a second sidewall positioned on the downstream side of the first sidewall and extending toward the downstream side; and the pulverization chamber is enlarged at its part on the side more upstream than the outermost edge of the second impact face so as to have a zone where the cross-sectional area of the inside of the pulverization chamber is larger than the cross-sectional area of the inside of the pulverization chamber corresponding to the outermost edge of the second impact face, and a tip of the first impact face is positioned on the side more upstream than the downstream side edge of the first sidewall; and the distance between the outermost edge of the second impact face and the accelerating tube outlet is L4, and the distance between the accelerating tube outlet and the second sidewall is L5, with $L5 \leqq L4$.

16. The process according to claim 15, further comprising the step of providing the pulverizer such that the vertical angle $\alpha$ and the slope angle $\beta$ satisfy the following relationship:

$0<\alpha<90,\ \beta>0$ $30 \leqq (\alpha+2\beta) \leqq 90$.

17. The process according to claim 15, further comprising the step of providing the pulverizer such that the vertical angle $\alpha$ and said slope angle $\beta$ satisfy the following relationship:

$0<\alpha<90,\ \beta>0$ $50\leqq(\alpha+2\beta)\leqq 90.$

18. The process according to claim 15, further comprising the step of providing the pulverizer such that when the diameter across the outermost edge of the second impact face is represented by width A, the maximum diameter of the space formed by the upstream sidewall of the pulverization chamber standing opposite to the impact member by width B, and the minimum diameter of the space formed by the second sidewall by width C, the A, B and C satisfy the following relationship:

$C<B\leqq 1.6\times C$ $A<C<1.6\times A.$

19. The process according to claim 15, further comprising the step of providing the pulverizer such that when the diameter across the outermost edge of the second impact face is represented by width A, the maximum diameter of the space formed by the upstream sidewall of the pulverization chamber standing opposite to the impact member by width B, and the minimum diameter of the space formed by the second sidewall by width C, the A, B and C satisfy the following relationship:

$C<B\leqq 1.2\times C$ $A<C<1.5\times A.$

20. The process according to claim 15, further comprising the step of providing the pulverizer such that when the diameter across the outermost edge of the second impact face is represented by width A, the maximum diameter of the space formed by the upstream sidewall of the pulverization chamber standing opposite to the impact member by width B, and the minimum diameter of the space formed by the second sidewall by width C, the A, B and C satisfy the following relationship:

$C<B\leqq 1.6\times C$ $A<C<1.6\times A$; and when the diameter of the accelerating tube outlet is represented by D, the distance between the accelerating tube outlet and the top of the first impact face by L1, the height of the first impact face by L2, the height of said second impact face by L3, the distance between the outermost edge of the second impact face and the accelerating tube outlet by L4, and the distance between the accelerating tube outlet and the second sidewall by L5, the L1, L2, L3, L4 and L5 satisfy the following relationship:

$|L1|\leqq D/\{2\times\tan(\alpha/2)\}$ $L5\leqq L4\leqq L2+L3.$

21. The process according to claim 15, further comprising the step of providing the pulverizer such that when the diameter across the outermost edge of the second impact face is represented by width A, the maximum diameter of the space formed by the upstream sidewall of the pulverization chamber standing opposite to the impact member by width B, and the minimum diameter of the space formed by the second sidewall by width C, the A, B and C satisfy the following relationship:

$C<B\leqq 1.6\times C$ $A<C<1.6\times A$; and when the diameter of the accelerating tube outlet is represented by D, the distance between the accelerating tube outlet and the top of the first impact face by L1, the height of the first impact face by L2, the height of the second impact face by L3, the distance between the outermost edge of the second impact face and the accelerating tube outlet by L4, and the distance between the accelerating tube outlet and the second sidewall by L5, the L1, L2, L3 L4 and L5 satisfy the following relationship:

$0<L1\leqq D/\{2\times\tan(\alpha/2)\}$ $L5\leqq L4\leqq L2+L3.$

22. The process according to claim 15, further comprising the step of providing the pulverizer such that the impact member has a conical shape with a vertical angle $\gamma$ at its side opposite to the side on which the first impact face and second impact face are provided;

when the diameter across the outermost edge of the second impact face is represented by width A, the maximum diameter of the space formed by the upstream sidewall of the pulverization chamber standing opposite to the impact member by width B, and the minimum diameter of the space formed by the second sidewall by width C, the A, B and C satisfy the following relationship:

$C<B\leqq 1.6\times C$ $A<C<1.6\times A$;

when the diameter of the accelerating tube outlet is represented by D, the distance between the accelerating tube outlet and the top of the first impact face by L1, the height of the first impact face by L2, the height of the second impact face by L3, the distance between the outermost edge of the second impact face and the accelerating tube outlet by L4, and the distance between the accelerating tube outlet and the second sidewall by L5, the L1, L2, L3, L4 and L5 satisfy the following relationship:

$|L1|\leqq D/\{2\times\tan(\alpha/2)\}$ $L5\leqq L4\leqq L2+L3$;

when the diameter of the most enlarged part in the zone extending from the lowermost part of the second sidewall of the pulverization chamber to the pulverized product discharge outlet is represented by F, the F and C satisfy the following relationship:

$F>C$; and the vertical angle $\gamma$ of the impact member satisfies the following relationship:

$0<\gamma<90.$

23. The process according to claim 15, further comprising the step of providing the pulverizer such that the impact member has a conical shape with a vertical angle $\gamma$ at its side opposite to the side on which the first impact face and second impact face are provided;

when the diameter across the outermost edge of the second impact face is represented by width A, the maximum diameter of the space formed by the upstream sidewall of the pulverization chamber standing opposite to said impact member by width B, and the minimum diameter of the space formed by the second sidewall by width C, the A, B and C satisfy the following relationship:

$C<B\leqq 1.6\times C$ $A<C<1.6\times A$;

when the diameter of the accelerating tube outlet is represented by D, the distance between the accelerating tube outlet and the top of the first impact face by L1, the height of the first impact face by L2, the height of the second impact face by L3, the distance between the outermost edge of the second impact face and the accelerating tube outlet by L4, and the distance between the accelerating tube outlet and the second sidewall by L5, the L1, L2, L3, L4 and L5 satisfy the following relationship:

$0<L1\leqq D/\{2\times\tan(\alpha/2)\}$ $L5\leqq L4\leqq L2+L3$;

when the diameter of the most enlarged part in the zone extending from the lowermost part of the second sidewall of the pulverization chamber to the pulverized product discharge outlet is represented by F, the F and C satisfy the following relationship:

$F>C$; and the vertical angle $\gamma$ of the impact member satisfies the following relationship:

$0<\gamma<90$.

24. The process according to claim 15, further comprising the step of providing the pulverizer such that the accelerating tube is provided at an inclination of from 0 to 45° in the axial direction of the accelerating tube on the basis of the its vertical line.

25. The process according to claim 15, further comprising the step of providing the pulverizer such that the accelerating tube is provided at an inclination of from 0 to 20° in the axial direction of the accelerating tube on the basis of its vertical line.

26. The process according to claim 15, further comprising the step of providing the pulverizer such that the accelerating tube is provided at an inclination of from 0 to 5° in the axial direction of the accelerating tube on the basis of its vertical line.

27. The process according to claim 15, further comprising the step of providing the pulverizer such that the pulverization chamber has a pulverized product discharge outlet for discharging the pulverized product from the pulverization chamber, provided on the side more downstream than the impact member and in the direction opposite to the side on which the impact faces of the impact member are provided.

28. The process according to claim 15, further comprising the step of providing the pulverizer such that the accelerating tube has a pulverizing material feed opening for feeding the pulverizing material into the accelerating tube through the circumference of the accelerating tube.

29. A pneumatic impact pulverizer comprising:

a high-pressure gas feed nozzle for feeding a high-pressure gas;

a single accelerating tube for transporting and accelerating a pulverizing material in said accelerating tube by the aid of the high-pressure gas fed through said high-pressure gas feed nozzle;

a pulverization chamber for pulverizing the pulverizing material ejected out of an accelerating tube outlet; and an impact member for pulverizing the pulverizing material ejected out of said accelerating tube outlet, provided at a position opposite to said accelerating tube outlet in said pulverization chamber, wherein said impact member has at least a first impact face projecting toward said accelerating tube side at a vertical angle $\alpha$ around the axis of said accelerating tube and a second impact face sloped toward the downstream side at an angle $\beta$ with respect to a perpendicular line formed toward the axis of said accelerating tube;

said pulverization chamber has at least a first sidewall positioned on the side more upstream than an outermost edge of said second impact face, a second sidewall positioned on the downstream side of said first sidewall and extending toward the downstream side, and as a third sidewall a pulverization chamber impact wall that connects said first sidewall with said second sidewall, faces said outermost edge of said second impact face and is sloped at an angle $\theta$ toward the outer side with respect to the axis of said accelerating tube and toward the downstream side; and said pulverization chamber is enlarged at its part on the side more upstream than said outermost edge of said second impact face so as to have a zone where the cross-sectional area of the inside of said pulverization chamber is larger than the cross-sectional area of the inside of said pulverization chamber corresponding to said outermost edge of said second impact face, and a tip of said first impact face is positioned on the side more upstream than the downstream side edge of said first sidewall.

30. The pneumatic impact pulverizer according to claim 29, wherein said vertical angle $\alpha$ and said slope angle $\beta$ satisfy the following relationship:

$0<<90$, $\beta>0$, $30\leqq(\alpha+2\beta)\leqq 90$.

31. The pneumatic impact pulverizer according to claim 29, wherein said vertical angle $\alpha$ and said slope angle $\beta$ satisfy the following relationship:

$0<\alpha<90$, $\beta>0$, $50\leqq(\alpha+2\beta)\leqq 90$.

32. The pneumatic impact pulverizer according to claim 29, wherein, when the diameter across said outermost edge of said second impact face is represented by width A, the maximum diameter of the space formed by an upstream sidewall of said pulverization chamber standing opposite to said impact member by width B, and the diameter of the space formed by said pulverization chamber impact wall at its innermost edge by width E, and the minimum diameter of the space formed by said second sidewall by width C, the A, B, C and E satisfy the following relationship:

$$C<B\leq 2\times C,$$

$$A<C<1.6\times A,$$

$$C>E.$$

33. The pneumatic impact pulverizer according to claim 29, wherein, when the diameter across said outermost edge of said second impact face is represented by width A, the maximum diameter of the space formed by an upstream sidewall of said pulverization chamber standing opposite to said impact member by width B, the diameter of the space formed by said pulverization chamber impact wall at its innermost edge by width E, and the minimum diameter of the space formed by said second sidewall by width C, the A, B, C and E satisfy the following relationship:

$$C<B\leq 1.3\times C,$$

-continued $$A < C < 1.5 \times A,$$

$$C > E.$$

34. The pneumatic impact pulverizer according to claim 29, wherein, when the diameter across said outermost edge of said second impact face is represented by width A, the maximum diameter of the space formed by an upstream sidewall of said pulverization chamber standing opposite to said impact member by width B, the diameter of the space formed by said pulverization chamber impact wall at its innermost edge by width E, and the minimum diameter of the space formed by said second sidewall by width C, the A, B, C and E satisfy the following relationship:

$$C < B \leq 2 \times C,$$

$$A < C < 1.6 \times A,$$

$$C > E;$$

when the diameter of said accelerating tube outlet is represented by D, the distance between said accelerating tube outlet and a top of said first impact face by L1, the height of said first impact face by L2, the height of said second impact face by L3, the distance between said outermost edge of said second impact face and said accelerating tube outlet by L4, and the distance between said outermost edge of said second impact face and an innermost edge of said third sidewall by L6, the L1, L2, L3, L4 and L6 satisfy the following relationship:

$$|L1| \leq D / \{2 \times \tan(\alpha / 2)\},$$

$$L6 \leq L4 \leq L2 + L3,$$

$$0 < L6 < 2 \times L3; \text{ and}$$

the angle θ of slope of said third sidewall satisfies the following relationship:
$0<\theta<40$.

35. The pneumatic impact pulverizer according to claim 29, wherein, when the diameter across the outermost edge of said second impact face is represented by width A, the maximum diameter of the space formed by an upstream sidewall of said pulverization chamber standing opposite to said impact member by width B, the diameter of the space formed by said pulverization chamber impact wall at its innermost edge by width E, and the minimum diameter of the space formed by said second sidewall by width C, the A, B, C and E satisfy the following relationship:

$$C < B \leq 2 \times C,$$

$$A < C < 1.6 \times A,$$

$$C > E;$$

when the diameter of said accelerating tube outlet is represented by D, the distance between said accelerating tube outlet and a top of said first impact face by L1, the height of said first impact face by L2, the height of said second impact face by L3, the distance between said outermost edge of said second impact face and said accelerating tube outlet by L4, and the distance between said outermost edge of said second impact face and an innermost edge of said third sidewall by L6, the L1, L2, L3, L4 and L6 satisfy the following relationship:

$$0 < L1 \leq D / \{2 \times \tan(\alpha / 2)\},$$

$$L6 \leq L4 \leq L2 + L3,$$

$$0 < L6 < 2 \times L3; \text{ and}$$

the angle θ of slope of said third sidewall satisfies the following relationship:
$0<\theta<40$.

36. The pneumatic impact pulverizer according to claim 29, wherein said accelerating tube is provided at an inclination of from 0 to 45° in the axial direction of said accelerating tube on the basis of its vertical line.

37. The pneumatic impact pulverizer according to claim 29, wherein said accelerating tube is provided at an inclination of from 0 to 20° in the axial direction of said accelerating tube on the basis of its vertical line.

38. The pneumatic impact pulverizer according to claim 29, wherein said accelerating tube is provided at an inclination of from 0 to 5° in the axial direction of said accelerating tube on the basis of its vertical line.

39. The pneumatic impact pulverizer according to claim 29, wherein said pulverization chamber includes a pulverized product discharge outlet for discharging the pulverized product from said pulverization chamber, provided on a side more downstream than said impact member and in the direction opposite to the side on which impact faces of said impact member are provided.

40. The pneumatic pulverizer according to claim 29, wherein said accelerating tube includes a pulverizing material feed opening for feeding the pulverized material into said accelerating tube through the circumference of said accelerating tube.

41. A process for producing a toner, comprising the steps of:

melt-kneading a mixture containing at least a binder resin and a colorant, to obtain a kneaded product;

cooling the resultant kneaded product to obtain a solidified product;

crushing the resultant solidified product to obtain a crushed product;

pulverizing the resultant crushed product by means of a pneumatic impact pulverizer; and providing a pneumatic impact pulverizer to pulverize the crushed product, with the pulverizer including:

a high-pressure gas feed nozzle for feeding a high-pressure gas;

a single accelerating tube for transporting and accelerating a pulverizing material in the accelerating tube by the aid of the high-pressure gas fed through the high-pressure gas feed nozzle;

a pulverization chamber for pulverizing the pulverizing material ejected out of an accelerating tube outlet; and an impact member for pulverizing the pulverizing material ejected out of the accelerating tube outlet, provided at a position opposite to the accelerating tube outlet in the pulverization chamber, wherein the impact member has at least a first impact face projecting toward the accelerating tube side at a vertical angle α around the axis of the accelerating tube and a second impact face sloped toward the downstream side at an angle β with respect to a perpendicular line formed toward the axis of the accelerating tube;

the pulverization chamber has at least a first sidewall positioned on the side more upstream than the outermost edge of the second impact face, a second sidewall positioned on the downstream side of the first sidewall and extending toward the downstream side, and as a third sidewall a pulverization chamber impact wall that connects the first sidewall with the second sidewall, faces the outermost edge of said second impact face and is sloped at an angle θ toward the outer side with respect to the axis of the accelerating tube and toward the downstream side; and the pulverization chamber is enlarged at its part on the side more upstream than the outermost edge of the second impact face so as to have a zone where the cross-sectional area of the inside of the pulverization chamber is larger than the cross-sectional area of the inside of the pulverization chamber corresponding to the outermost edge of the second impact face, and a tip of the first impact face is positioned on the side more upstream than the downstream side edge of the first sidewall.

42. The process according to claim 41, further comprising the step of providing the pulverizer such that the vertical angle α and the slope angle β satisfy the following relationship:

$0<\alpha<90,\ \beta>0,$ $30\leqq(\alpha+2\beta)\leqq 90.$

43. The process according to claim 41, further comprising the step of providing the pulverizer such that the vertical angle α and the slope angle β satisfy the following relationship:

$0<\alpha<90,\ \beta>0,$ $50\leqq(\alpha+2\beta)\leqq 90.$

44. The process according to claim 41, further comprising the step of providing the pulverizer such that when the diameter across the outermost edge of the second impact face is represented by width A, the maximum diameter of the space formed by the upstream sidewall of the pulverization chamber standing opposite to the impact member by width B, the diameter of the space formed by the pulverization chamber impact wall at its innermost edge by width E, and the minimum diameter of the space formed by said second sidewall by width C, the A, B, C and E satisfy the following relationship:

$$C < B \leq 2\times C,$$

$$A < C < 1.6\times A,$$

$$C > E.$$

45. The process according to claim 41, further comprising the step of providing the pulverizer such that when the diameter across the outermost edge of the second impact face is represented by width A, the maximum diameter of the space formed by the upstream sidewall of the pulverization chamber standing opposite to the impact member by width B, the diameter of the space formed by the pulverization chamber impact wall at its innermost edge by width E, and the minimum diameter of the space formed by said second sidewall by width C, the A, B, C and E satisfy the following relationship:

$$C < B \leq 1.3\times C,$$

$$A < C < 1.5\times A,$$

$$C > E.$$

46. The process according to claim 41, further comprising the step of providing the pulverizer such that when the diameter across the outermost edge of the second impact face is represented by width A, the maximum diameter of the space formed by the upstream sidewall of the pulverization chamber standing opposite to the impact member by width B, the diameter of the space formed by the pulverization chamber impact wall at its innermost edge by width E, and the minimum diameter of the space formed by the second sidewall by width C, the A, B, C and E satisfy the following relationship:

$$C < B \leq 2\times C,$$

$$A < C < 1.6\times A,$$

$$C > E;$$

when the diameter of the accelerating tube outlet is represented by D, the distance between the accelerating tube outlet and a top of the first impact face by L1, the height of the first impact face by L2, the height of said second impact face by L3, the distance between the outermost edge of the second impact face and the accelerating tube outlet by L4, and the distance between the outermost edge of the second impact face and an innermost edge of the third sidewall by L6, the L1, L2, L3, L4 and L6 satisfy the following relationship:

$$|L1| \leq D/\{2\times\tan(\alpha/2)\},$$

$$L6 \leq L4 \leq L2 + L3,$$

$$0 < L6 < 2\times L3;\ \text{and}$$

the angle θ of slope of the third sidewall satisfies the following relationship:

$0<\theta<40.$

47. The process according to claim 41, further comprising the step of providing the pulverizer such that when the diameter across the outermost edge of the second impact face is represented by width A, the maximum diameter of the space formed by the upstream sidewall of the pulverization chamber standing opposite to the impact member by width B, the diameter of the space formed by the pulverization chamber impact wall at its innermost edge by width E, and the minimum diameter of the space formed by the second sidewall by width C, the A, B, C and E satisfy the following relationship:

$$C < B \leq 2\times C,$$

$$A < C < 1.6\times A,$$

$$C > E;$$

when the diameter of the accelerating tube outlet is represented by D, the distance between the accelerating tube outlet and a top of the first impact face by L1, the height of the first impact face by L2, the height of the second impact face by L3, the distance between the outermost edge of the second impact face and the accelerating tube outlet by L4, and the distance between the outermost edge of the second impact face and the innermost edge of the third sidewall by L6, the L1, L2, L3, L4 and L6 satisfy the following relationship:

$$0 < L1 \leq D/\{2 \times \tan(\alpha/2)\},$$

$$L6 \leq L4 \leq L2 + L3,$$

$$0 < L6 < 2 \times L3; \text{ and}$$

the angle θ of slope of the third sidewall satisfies the following relationship:

0<θ40.

48. The process according to claim 41, further comprising the step of providing the pulverizer such that the accelerating tube is provided at an inclination of from 0 to 45° in the axial direction of the accelerating tube on the basis of its vertical line.

49. The process according to claim 41, further comprising the step of providing the pulverizer such that the accelerating tube is provided at an inclination of from 0 to 20° in the axial direction of the accelerating tube on the basis of its vertical line.

50. The process according to claim 41, further comprising the step of providing the pulverizer such that the accelerating tube is provided at an inclination of from 0 to 5° in the axial direction of the accelerating tube on the basis of its vertical line.

51. The process according to claim 41, further comprising the step of providing the pulverizer such that the pulverization chamber has a pulverized product discharge outlet for discharging the pulverized product from the pulverization chamber, provided on the side more downstream than the impact member and in the direction opposite to the side on which the impact faces of the impact member are provided.

52. The process according to claim 41, further comprising the step of providing the pulverizer such that the accelerating tube has a pulverizing material feed opening for feeding the pulverizing material into the accelerating tube through the circumference of the accelerating tube.

* * * * *

UNITED STATES PATENT AND TRADEMARK OFFICE

CERTIFICATE OF CORRECTION

PATENT NO. : 5,934,575

DATED : August 10, 1999

INVENTOR(S) : TOSHINOBU OHNISHI, ET AL.

It is certified that error appears in the above-identified patent and that said Letters Patent is hereby corrected as shown below:

COLUMN 20:

Line 23, "1-hydroxy-4-naphthoslulfonate" should read --1-hydroxy-4-naphthosulfonate--.
Line 24, "teterafluoroborate" should read --tetrafluoroborate--.

COLUMN 21:

Line 10, "slilane" should read --silane--.

Signed and Sealed this

Twenty-ninth Day of August, 2000

*Attest:*

*Attesting Officer*

Q. TODD DICKINSON

*Director of Patents and Trademarks*